US005135214A

United States Patent [19]

Sugimoto et al.

[11] Patent Number: 5,135,214

[45] Date of Patent: Aug. 4, 1992

[54] FEEDING DEVICE

[75] Inventors: Yuji Sugimoto; Souichi Takata, both of Nara; Osamu Wakuda, Yamatotakada, all of Japan

[73] Assignee: Sharp Kabushiki Kaisha, Osaka, Japan

[21] Appl. No.: 732,226

[22] Filed: Jul. 17, 1991

[30] Foreign Application Priority Data

Jul. 20, 1990 [JP] Japan ..... 2-193455
Jul. 31, 1990 [JP] Japan ..... 2-205696
Aug. 31, 1990 [JP] Japan ..... 2-231557

[51] Int. Cl.[5] ..... B65H 9/12
[52] U.S. Cl. ..... 271/241; 271/164
[58] Field of Search ..... 271/127, 145, 162, 164, 271/225, 227, 241, 254, 902

[56] References Cited

U.S. PATENT DOCUMENTS 5,003,493 3/1991 Okapa et al. ..... 271/162 X
5,083,767 1/1992 Iwamoto et al. ..... 271/162 X

FOREIGN PATENT DOCUMENTS 56-059245 5/1981 Japan .
124634 7/1984 Japan ..... 271/145
262735 12/1985 Japan ..... 271/145
1-32021 5/1990 Japan ..... 271/162

*Primary Examiner*—Robert P. Olszewski
*Assistant Examiner*—Boris Milef
*Attorney, Agent, or Firm*—David G. Conlin

[57] ABSTRACT

A feeding device has a rotative threaded shaft and a rotatable paper tray. A movable joint is attached to the rotative threaded shaft, and permitted to move on the shaft. The movable joint is coupled to one corner of the rotatable paper tray. A shaft drive plate is secured to the movable joint. In the vicinity of the rotative threaded shaft, is disposed a shifting shaft extending in the direction of movable joint movements, which is permitted to freely move in the direction. An engaging member to be depressed by engaging the shaft drive plate and a spring to urge the shifting shaft to be located in a predetermined position, are attached to the shifting shaft. On the other hand, in the feeding device main body, there are installed an action plate for making a forward or backward movement in response to a movement of the shifting shaft driven by the shaft drive plate and switch for performing ON/OFF operation in response to shifting positions of the action plate. Thus, this arrangement makes it possible to reduce the number of required parts for connecting the feeding device to the feeding device main body and for detecting operating conditions of the rotatable paper tray.

12 Claims, 23 Drawing Sheets

FEEDING DEVICE

FIELD OF THE INVENTION

The present invention relates to a paper feeding device for use in, for example, a copying machine, wherein a rotatable paper tray storing sheets of paper is adapted to rotatively shift itself either in a lateral position or in a longitudinal position.

BACKGROUND OF THE INVENTION

Conventionally, a paper feeding device for supplying sheets of paper is provided in an apparatus such as a copying machine. As shown in FIG. 16 through FIG. 18, in some paper feeding devices, a rotatable paper tray unit 72 having a rotatable paper tray 71 installed therein is supported to a feeding device main body 74 by a sliding mechanism 73 and thereby adapted to be drawn from the feeding device main body 74 so as to store or exchange sheets of paper. A state of attachment of the rotatable paper unit tray 72 to the feeding device main body 74 is detected by a sensor (not shown).

In order to permit either longitudinal or lateral feeding of sheets of paper stored therein, the rotatable paper tray 71 is adapted to reversibly rotate to either a lateral feeding position shown by a solid line in FIGS. 16 and 17 as well as shown in FIG. 18 or a longitudinal feeding position shifted from the above position by an angle of 90°, which is shown by an alternate long and two short dashes line in FIG. 16 and FIG. 17.

The rotation of the rotatable paper tray 71 is performed by a mechanism wherein a movable member 75 coupled to one corner of the rotatable paper tray 71 is shifted by the rotation of a rotative threaded shaft 76 having a thread on its surface. Further, the longitudinal or lateral feeding position of the rotatable paper tray 71 is detected by a mechanism that a projecting member 75*a* attached to the movable member 75 is detected by a longitudinal feeding position sensor 78 or a lateral feeding position sensor 79 installed in a tray housing 77.

The sensors 78 and 79 are connected to a control device, not shown, installed in the feeding device main body 74 through a harness 80 and a connector 81. While the longitudinal or lateral feeding position of the rotatable paper tray 71 is detected by the sensor 78 or 79, various operations such as the next rotation operation of the rotatable paper tray 71 and a feeding operation from the rotatable paper tray 71 are executed by instructions from the control device (not shown).

However, in the above conventional arrangement, since the longitudinal and lateral feeding position sensors 78 and 79 are installed in the rotatable paper tray unit 72 and connected to the feeding device main body 74 by the harness 80, a wiring process of the harness 80 should be carried out by taking into account attaching and removing operations of the rotatable paper tray unit 72 to and from the feeding device main body 74. This process causes complicated work.

Moreover, the conventional arrangement requires the connector 81 for connecting the harness 80 to, for example, the feeding device main body 74 and a number of sensors such as those for detecting a state of the rotatable paper tray unit 72 whether it is attached to or removed from the feeding device main body 74 and those longitudinal and lateral feeding position sensors 78 and 79. This causes such a drawback that necessary parts are increased in number.

As illustrated in FIG. 19 and FIG. 20, in another arrangement, the longitudinal or lateral feeding position of the rotatable paper tray 71 is detected by a longitudinal-lateral position detector for rotatable paper tray, which is provided with a light interrupting plate 75*a*′ normally coupled to the rotatable paper tray 71 so as to be shifted along the rotative threaded shaft 76 in accordance with the rotation of the rotatable paper tray 71, and further provided with optical longitudinal and lateral feeding position sensors 79′ and 78′ installed in the tray housing 77 of the rotatable paper tray unit 72 for detecting the light interrupting plate 75*a*′.

The sensors 78′ and 79′ are connected to a control device, not shown, installed in the feeding device main body 74 through a harness 80 and a connector 81. While the longitudinal or lateral feeding position of the rotatable paper tray 71 is detected by the longitudinallateral position detector for rotatable paper tray, various operations such as the next rotation operation of the rotatable paper tray 71, a raising operation of a paper carrying plate, not shown, in the rotatable paper tray 71 and feeding operation from the rotatable paper tray 71 are executed by instructions of the control device.

However, in the above conventional arrangement, since the longitudinal and lateral feeding position sensors 78′ and 79′ are installed in the rotatable paper tray unit 72 and connected to the feeding device main body 74 by the harness 80, a wiring process of the harness 80 should be carried out by taking into account attaching and removing operations of the rotatable paper tray unit 72 to and from the feeding device main body 74. This process causes complicated work. Further, the arrangement requires the connector 81 for connecting the harness 80 to, for example, the feeding device main body 74 and other devices, thereby causing such a drawback that required parts are increased in number.

SUMMARY OF THE INVENTION

It is an object of the present invention to reduce the number of connecting parts and detecting parts and required wiring processes associated with those parts, which parts and processes are required for detecting various operating conditions of a rotatable paper tray, that is, whether or not it is attached to the feeding device; which position it is situated in; whether or not it is in rotation, etc.

In a feeding device of the present invention, a rotatable paper tray unit having a tray housing member and a rotatable paper tray installed in the tray housing member, is removably attached to a feeding device main body. Further, the rotatable paper tray coupled to a transmission shaft member is attached to the tray housing member at a tray connecting point in such a manner that the rotatable paper tray may be reversibly rotated either to a longitudinal feeding position or a lateral feeding position by a forward or backward movement of the tray connecting point caused by a shifting movement of the transmission shaft member. In order to achieve the above-mentioned objects, the feeding device has the following arrangements.

The feeding device is provided in its main body with detection means which turn ON or OFF in accordance with the reciprocating movements of the tray connecting point caused by shifting movements of the transmission shaft member.

More specifically, for example, the following arrangement may be adopted: a shaft drive member moving together with the tray connecting point is attached to the transmission shaft member; a shifting shaft extending in a shifting direction of the transmission shaft member, capable of freely moving in this direction, is installed in the vicinity of the transmission shaft member; and an engaging member to be depressed by engaging the shaft drive member and an elastic member for urging the shifting shaft to be shifted at a predetermined position, are attached to the shifting shaft. Then, in the arrangement, detection means having an action plate making a forward or backward movement according to a movement of the shifting shaft driven by the shaft drive member and switching means for turning ON or OFF according to a position of the action plate, may be installed in the main body of the feeding device.

With the above arrangement, the rotatable paper tray is rotated to a longitudinal feeding position or a lateral feeding position by a mechanism that the connecting point thereof to the transmission shaft member is shifted by the transmission shaft member. At this time, the shaft drive member fixed to the transmission shaft member is moved together with the tray connecting point, and depresses the engaging member of the shifting shaft. Thus, the shifting shaft is moved in a direction of the depression, thereby driving the action plate of the detection means. According to the movement of the action plate at this time, the switching means turns ON or OFF, and thus an operating condition of the rotatable paper tray, that is; whether it is in the longitudinal or lateral feeding position; whether or not it is in rotation; etc. is detected.

In the feeding device of the present invention, since the detection means is installed in the feeding device main body, it is not necessary to provide a harness, between the rotatable paper tray unit and the feeding device main body, for connecting the detection means to the feeding device main body. Therefore, the arrangement can eliminate a complicated wiring process of the harness which has been carried out by taking into account a removing operation of the rotatable paper tray unit from the feeding device main body, thereby simplifying the fabrication process of the rotatable paper tray. Further, a connector for connecting the harness to the feeding device main body is not required.

Furthermore, the detection means may have another arrangement including an action plate, for example, a light interrupting plate, and switching means, for example, an optical sensor. The action plate, installed in the feeding device main body, makes a forward or backward movement according to a depressing action by the shifting shaft or a release of the depressing action taking place upon attaching or removing the rotatable paper tray unit to or from the feeding device main body, while also making a forward or backward movement according to a movement of the shifting shaft driven by the shaft drive member. The switching means turns ON or OFF according to a position of the action plate.

With the above arrangement, when the rotatable paper tray unit is attached to the feeding device main body, the action plate is depressed to move by the shifting shaft, and according to the movement of the action plate, the switching means turns ON or OFF, thereby making it possible to detect whether or not the rotatable paper tray unit is attached to the feeding device main body. When the rotatable paper tray unit is removed from the feeding device main body, the depression onto the action plate by the shifting shaft is released thereby allowing the action plate to move. Then, according to the movement of the action plate, the switching means turns ON or OFF, thereby making it possible to detect whether or not the rotatable paper tray unit is removed from the feeding device main body.

On the other hand, operating conditions of the rotatable paper tray under the attached state of the rotatable paper tray unit to the feeding device main body can be detected in the same manner as described in the arrangement of the above device.

Similarly, in the above device, the arrangement can eliminate a complicated wiring process of the harness which has been carried out by taking into account a removing operation of the rotatable paper tray unit from the feeding device main body, thereby simplifying the fabrication process of the rotatable paper tray. Further, a connector for connecting the harness to the feeding device main body is not required. Moreover, only one detection means can detect both a state of presence or absence of the rotatable paper tray unit in the feeding device main body and operating conditions of the rotatable paper tray, without employing separate detection means, thereby making it possible to reduce the number of required parts.

Furthermore, another arrangement may be adopted in the rotatable paper tray, wherein the rotatable paper tray is coupled to a movable member that is engaged to a rotative threaded member installed in the tray housing member such that the rotatable paper tray may be rotated to either a lateral feeding position or a longitudinal position by a mechanism that the movable member is shifted by the rotation of the rotative threaded member to make a forward or backward movement. In this case, the arrangement is provided with the following means.

The rotative threaded member is supported so as to freely move in its shaft direction, and the rotative threaded member has a depressing member. The rotatable paper tray is provided with an engaging section for setting a tray-side lateral feeding position and an engaging section for setting a tray-side longitudinal feeding position. On the other hand, the tray housing member is provided with an engaging section for setting a housing-member-side lateral feeding position and an engaging section for setting a housing-member-side longitudinal feeding position, each of which has an operative relation with the respective engaging section for setting the tray-side longitudinal or lateral feeding position, and when the rotatable paper tray is to be positioned in either the longitudinal or lateral position, locates the rotatable paper tray in the respective position by engaging with the respective engaging section for setting the tray-side longitudinal or lateral feeding position. Further, the feeding device main body is provided with detection means having an action plate, for example, a light interrupting plate, which moves forward or backward according to a movement of the depressing member caused by the rotation of the rotative threaded member and switching means, for example, an optical sensor, which turns ON or OFF according to a position of the action plate.

With the above arrangement, the rotatable paper tray is reversibly rotated to either the longitudinal or lateral feeding position by the mechanism that the movable member is shifted by the rotation of the rotative threaded member. The rotatable tray to be disposed in either the longitudinal or lateral feeding position is adjusted to be located in the longitudinal or lateral feeding position by an engagement between the engaging section for setting the tray-side lateral feeding position and the engaging section for setting the housing-member-side lateral feeding position or between the engaging section for setting a tray-side longitudinal feeding position and the engaging section for setting the housing-member-side longitudinal feeding position.

At this time, since the movable member coupled to the rotatable paper tray comes to a fixed state while the rotative threaded member is in rotation, the rotative threaded member is moved. According to the movement, the depressing member fixed to the rotative threaded member is moved, causing the action plate to move in response to the movement of the depressing member. In response to the movement of the action plate at this time, the switching means turns ON or OFF, and thus an operating condition of the rotatable paper tray, that is; whether it is in the longitudinal or lateral feeding position; whether or not it is in rotation; etc. is detected.

Further, processing operations of harnesses can be simplified, and no connector is required, thereby making it possible to reduce the number of the parts.

Furthermore, another arrangement may be adopted in the detection means, including an action plate, for example, a light interrupting plate and switching means, for example, optical sensors. The action plate, installed in the feeding device main body, makes a forward or backward movement according to a depressing action by the depressing member or a release of the depressing action taking place upon attaching or removing the rotatable paper tray unit to or from the feeding device main body while also making a forward or backward movement according to a movement of the depressing member given by the rotation of the rotative threaded member. Then, the switching means turn ON or OFF according to a position of the action plate.

With the above arrangement, when the rotatable paper tray is attached to the feeding device main body, the action plate is depressed to move by the depressing member, and according to the movement of the action plate, the switching means turn ON or OFF, thereby making it possible to detect whether or not the rotatable paper tray unit is attached to the feeding device main body. When the rotatable paper tray unit is removed from the feeding device main body, the depression onto the action plate by the depressing member is released, thereby allowing the action plate to move. Then, according to the movement of the action plate, the switching means turn ON or OFF, thereby making it possible to detect whether or not the rotatable paper tray unit is removed from the feeding device main body.

On the other hand, operating conditions of the rotatable paper tray under the attached state of the rotatable paper tray unit to the feeding device main body can be detected in the same manner as described in the foregoing arrangement. Further, processing operations of harnesses can be simplified, and no connector is required, thereby making it possible to reduce the number of the parts.

Furthermore, a feeding device of the present invention, wherein a rotatable paper tray unit having a rotatable paper tray capable of reversibly rotating to either a lateral feeding position or a longitudinal feeding position is removably attached to a feeding device main body, has a longitudinal-lateral position detection device for rotatable paper tray having a lateral feeding position sensor for detecting that the rotatable paper tray is located in the lateral feeding position and a longitudinal position sensor for detecting that the rotatable paper tray is located in the longitudinal position.

In order to achieve the foregoing object, concerning the above detection device, it is arranged that the longitudinal feeding position sensor and lateral feeding position sensor are installed in the feeding device main body.

With the above arrangement, since the longitudinal feeding position sensor and lateral feeding position sensor are installed in the feeding device main body, it is not necessary to provide a harness for connecting those sensors to the feeding device main body between the rotatable paper tray unit and the feeding device main body. Therefore, the arrangement can eliminate a complicated wiring process of the harness which has been carried out by taking into account a removing operation of the rotatable paper tray unit from the feeding device main body, thereby simplifying the fabrication process of the rotatable paper tray. Further, a connector for connecting the harness to the feeding device main body is not required.

For a fuller understanding of the nature and advantages of the invention, reference should be made to the ensuing detailed description taken in conjunction with the accompanying drawings.

BRIEF DESCRIPTION OF THE DRAWINGS

FIG. 1 is a plan view showing a rotatable paper tray unit wherein a rotatable paper tray is located in a lateral feeding position.

FIG. 2 is a plan view showing the rotatable paper tray unit wherein the rotatable paper tray is located in a longitudinal feeding position.

FIG. 3 is a plan view showing a state where the rotatable paper tray unit is removed from a feeding device main body with the rotatable paper tray located in the lateral feeding position.

FIG. 4 is a plan view illustrating a structure near a reducing mechanism shown in FIG. 1.

FIG. 5 is a perspective view illustrating a structure near the rotatable paper tray when it is located in the lateral feeding position.

FIG. 6 is a front view illustrating a shifting shaft and engaging members to be engaged by the shifting shaft.

FIG. 7 is a perspective view illustrating a structure of a sensor unit.

FIG. 8(*a*) is a sectional view of FIG. 4 taken in a direction P illustrating a state of the sensor unit when the rotatable paper tray is located in the lateral feeding direction.

FIG. 8(*b*) is a sectional view of FIG. 4 taken in a direction P illustrating a state of the sensor unit when the rotatable paper tray is in rotation.

FIG. 8(*c*) is a sectional view of FIG. 4 taken in a direction P illustrating a state of the sensor unit when the rotatable paper tray is located in the longitudinal feeding direction.

FIG. 8(*d*) is a sectional view of FIG. 4 taken in a direction P illustrating a state of the sensor unit when the rotatable paper tray unit is removed from the feeding device main body.

FIG. 9 is a plan view showing a rotatable paper tray unit wherein a rotatable paper tray is located in a lateral feeding position.

FIG. 10 is a plan view showing the rotatable paper tray unit wherein the rotatable paper tray is located in a longitudinal feeding position.

FIG. 11 is a plan view showing a state where the rotatable paper tray unit is removed from a feeding device main body with the rotatable paper tray located in the lateral feeding position.

FIG. 12(*a*) is a plan view illustrating a state of a compressed coil spring attached to an A' end portion of a rotative threaded shaft when the rotatable paper tray is in rotation.

FIG. 12(*b*) is a plan view illustrating a state of the compressed coil spring when the rotatable paper tray is located in the lateral feeding position.

FIG. 12(*c*) is a plan view illustrating a state of the compressed coil spring when the rotatable paper tray is located in the longitudinal feeding position.

FIG. 13(*a*) is a front view illustrating a state of a sensor unit when the rotatable paper tray is in rotation.

FIG. 13(*b*) is a front view illustrating a state of the sensor unit when the rotatable paper tray is located in the lateral feeding position.

FIG. 13(*c*) is a front view illustrating a state of the sensor unit when the rotatable paper tray is located in the longitudinal feeding position.

FIG. 13(*d*) is a front view illustrating a state of the sensor unit when the rotatable paper tray unit is removed from the feeding device main body.

FIG. 14 is a schematic plan view showing a feeding device.

FIG. 15 is a schematic front view of the feeding device.

FIG. 16 is a schematic plan view illustrating a rotatable paper tray unit attached to a feeding device main body.

FIG. 17 is a schematic front view of the rotatable paper tray unit of FIG. 16.

FIG. 18 is a schematic perspective view illustrating a structure near the rotatable paper tray when it is located in the lateral feeding position.

FIG. 19 is a schematic plan view showing another feeding device of the prior art.

FIG. 20 is a schematic front view of the feeding device of FIG. 19.

DESCRIPTION OF THE EMBODIMENTS

Referring to FIGS. 1 through 8, the following description will discuss one embodiment of the present invention.

Figure 1:
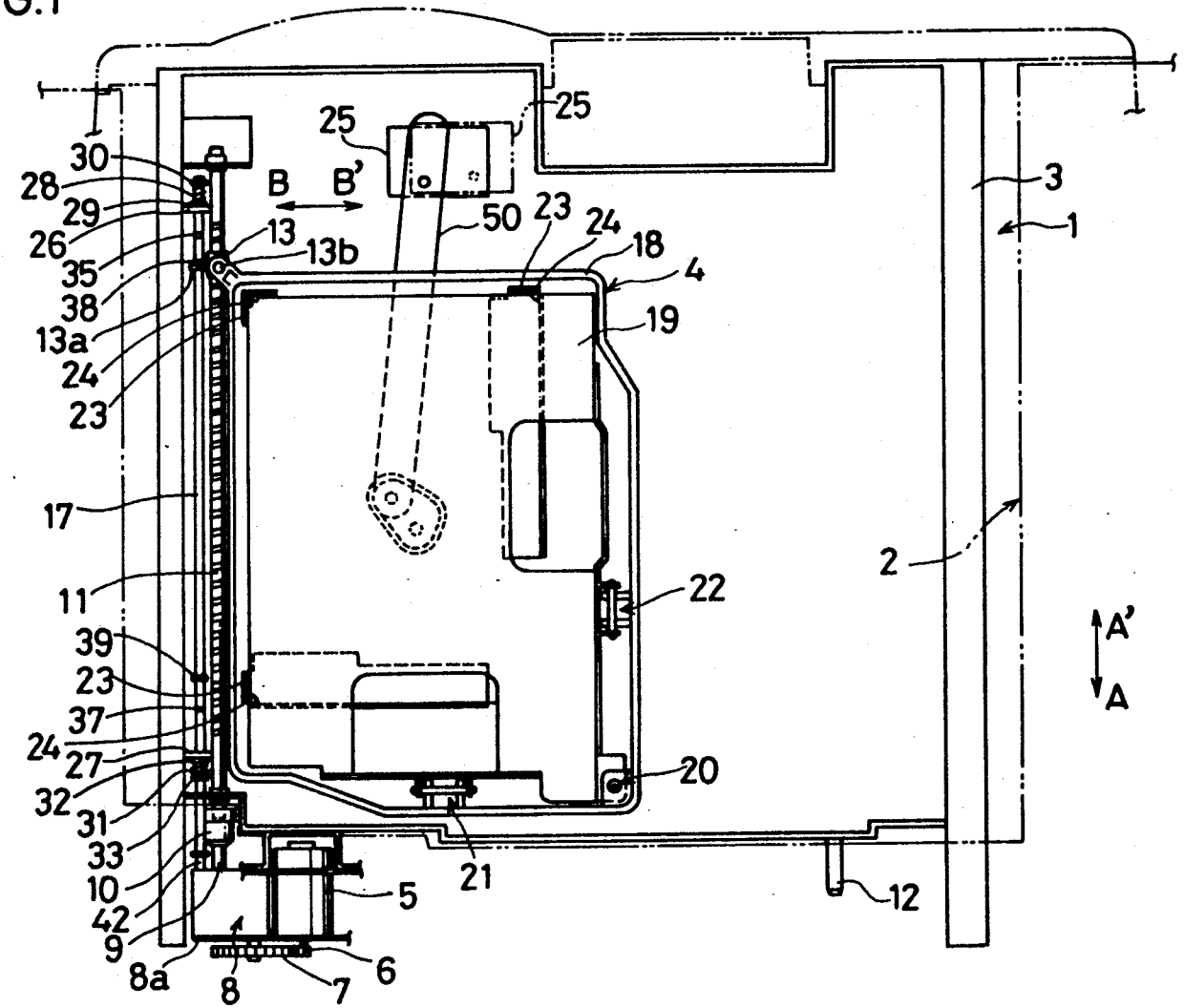
FIG. 1 through FIG. 8 show one embodiment of the present invention.
Figure 2:
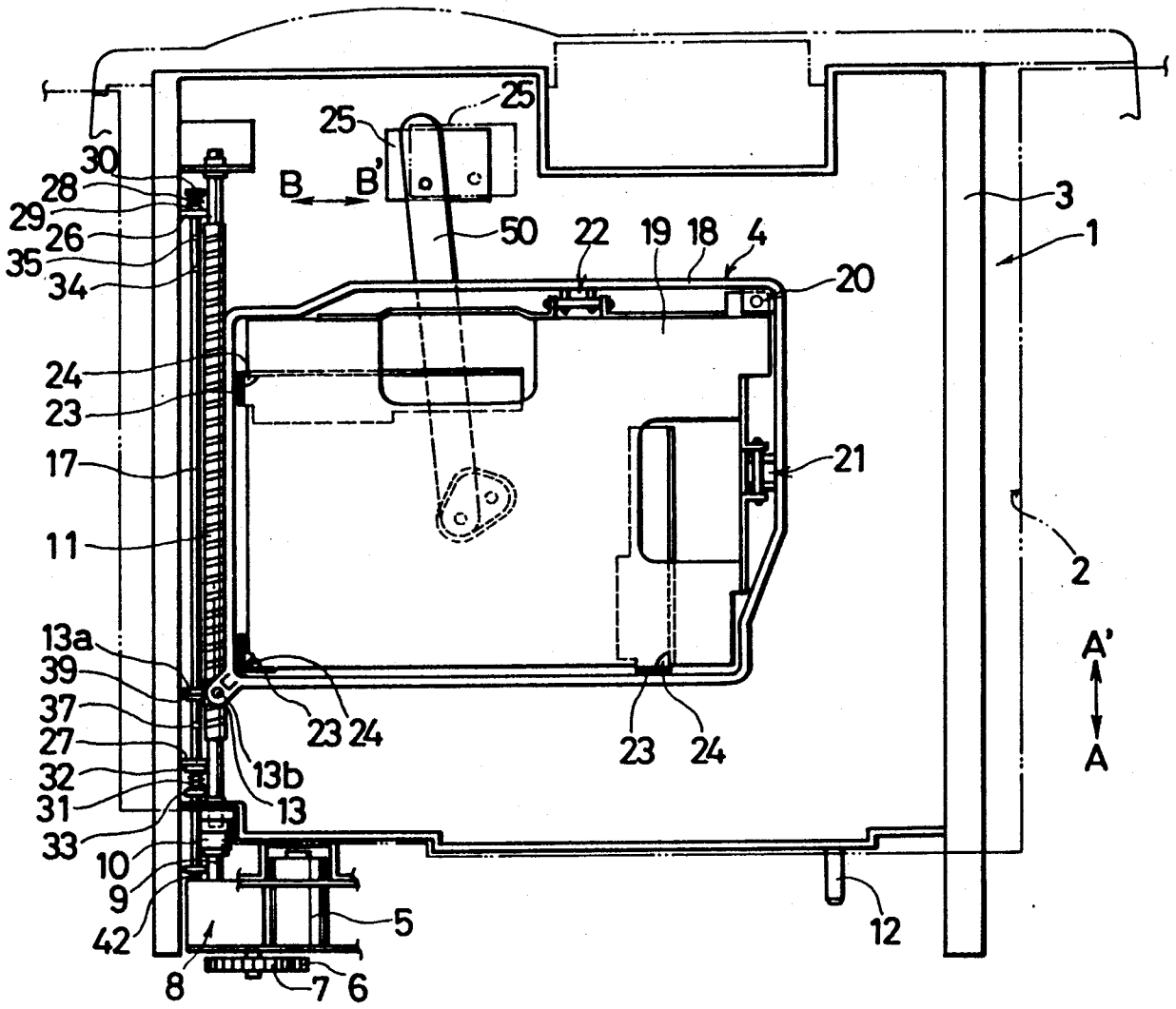
Figure 3:
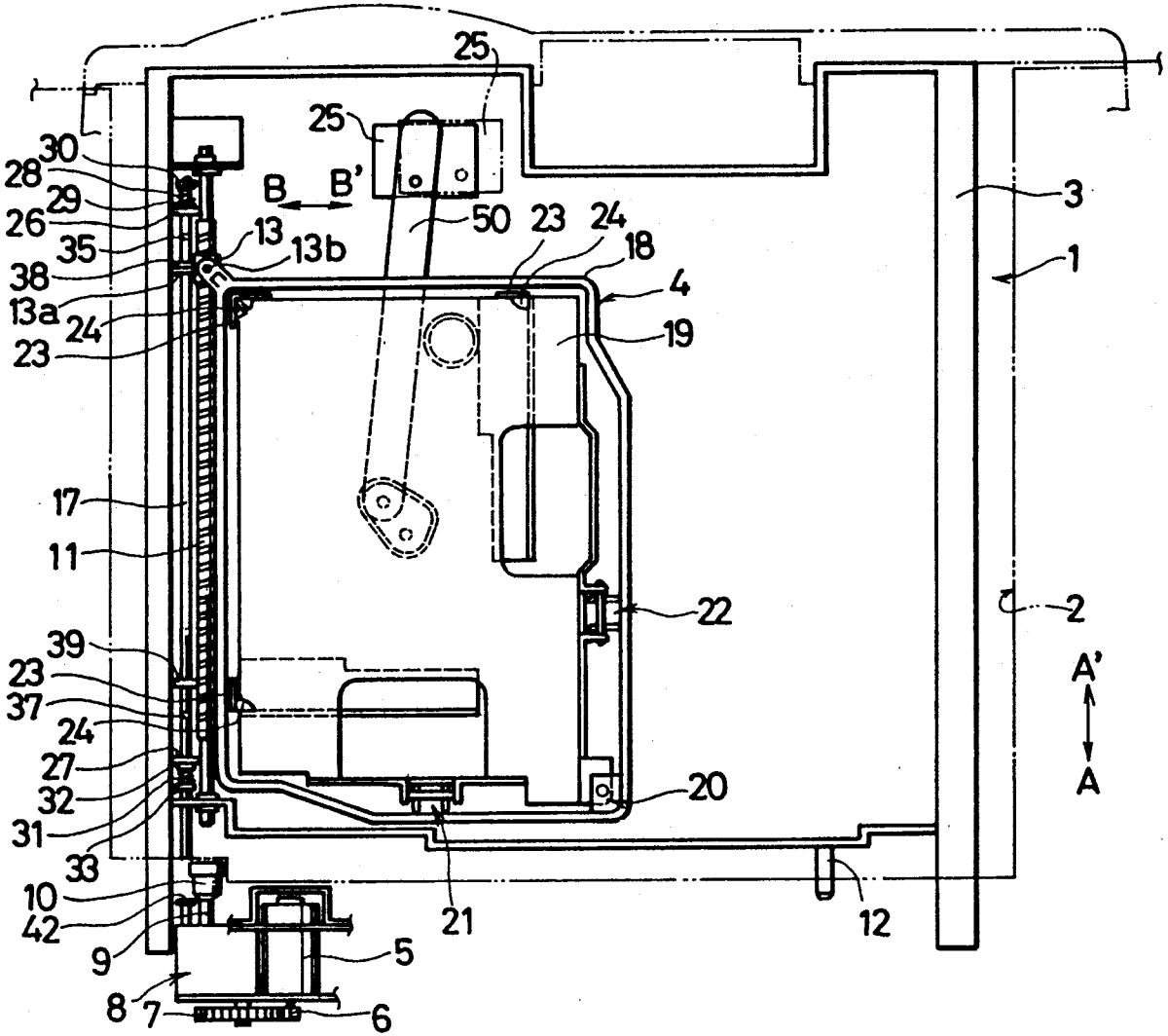

A feeding device according to the present invention is provided with a rotatable paper tray unit 1 as shown in FIGS. 1 through 3. The rotatable paper tray unit 1 has a tray housing 3 as a tray housing member serving as a case portion of the rotatable paper tray unit 1 and a rotatable paper tray 4 installed in the tray housing 3. Further, the rotatable paper tray unit 1 is supported to a feeding device main body 2 by a sliding mechanism (see FIG. 14 and FIG. 15) to be described later, disposed between the feeding device main body 2 and the tray housing 3, in such a manner that it can be attached to the feeding device main body 2 in a direction indicated by A, and removed therefrom in a direction indicated by A'.

Figure 4:
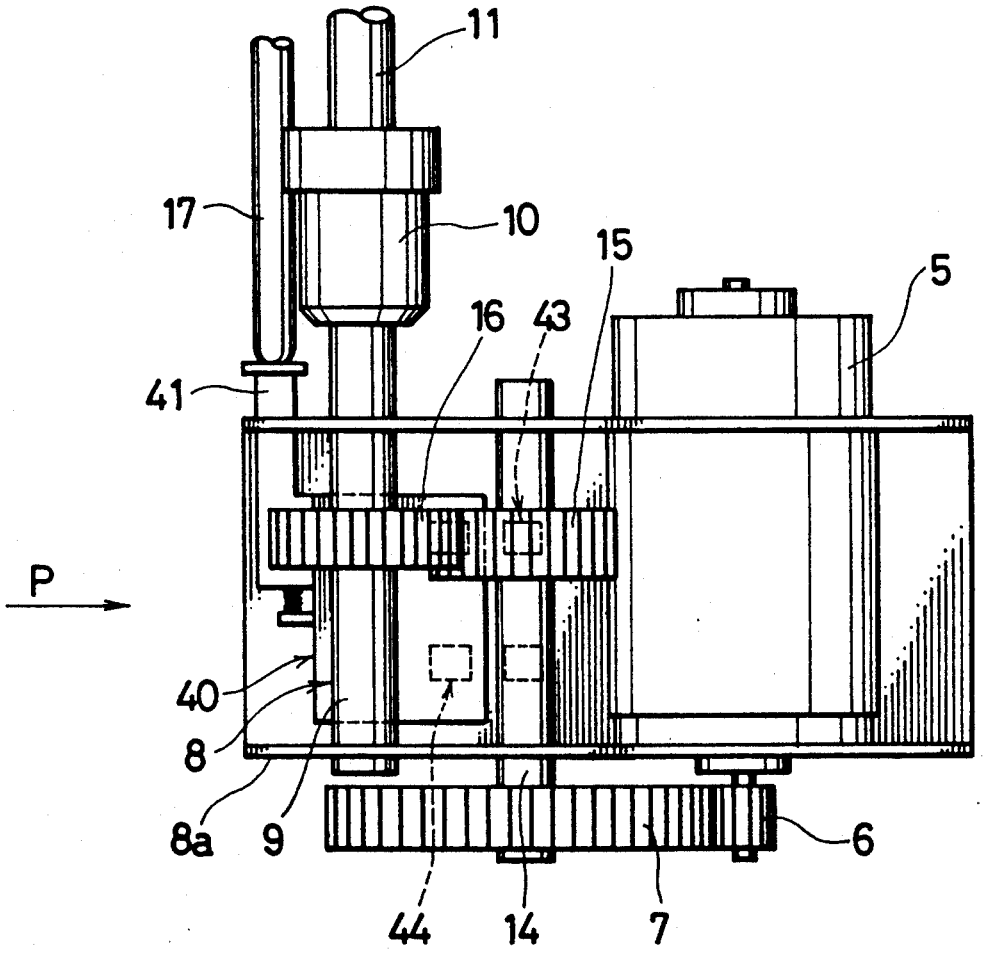

The feeding device main body 2 has a motor 5 for rotating the rotatable paper tray 4, and power from the motor 5 is transmitted to a rotative threaded shaft 11 functioning as a transmission shaft member of the rotatable paper tray unit 1 through gears 6 and 7, a reducing mechanism 8, a rotation shaft 9 and a coupling clutch 10. As illustrated in FIG. 4, the reducing mechanism 8 includes a rotation shaft 14 engaged by the gear 7, a gear 15 engaging the rotation shaft 14, and a gear 16 meshing with the gear 15.

On an end surface at an direction A side of the tray housing 3 in the rotatable paper tray unit 1, is fixed a guiding shaft 12 for use in attaching operations, and is disposed one end of the rotative threaded shaft 11 in a projecting manner so as to engage the coupling clutch 10. The rotative threaded shaft 11 having a thread, which will be described later, on the surface thereof so as to shift a movable joint 13, is rotatably disposed in a direction A—A' at an end portion on a direction B side of the tray housing 3, which corresponds to a paper feeding side. The movable joint 13 is meshed with the rotative threaded shaft 11, and adapted to move on the rotative threaded shaft 11 according to the rotation of the rotative threaded shaft 11. The movable joint 13 is connected to one corner of the rotatable paper tray 4 at a tray connecting point 13*b*.

Figure 5:
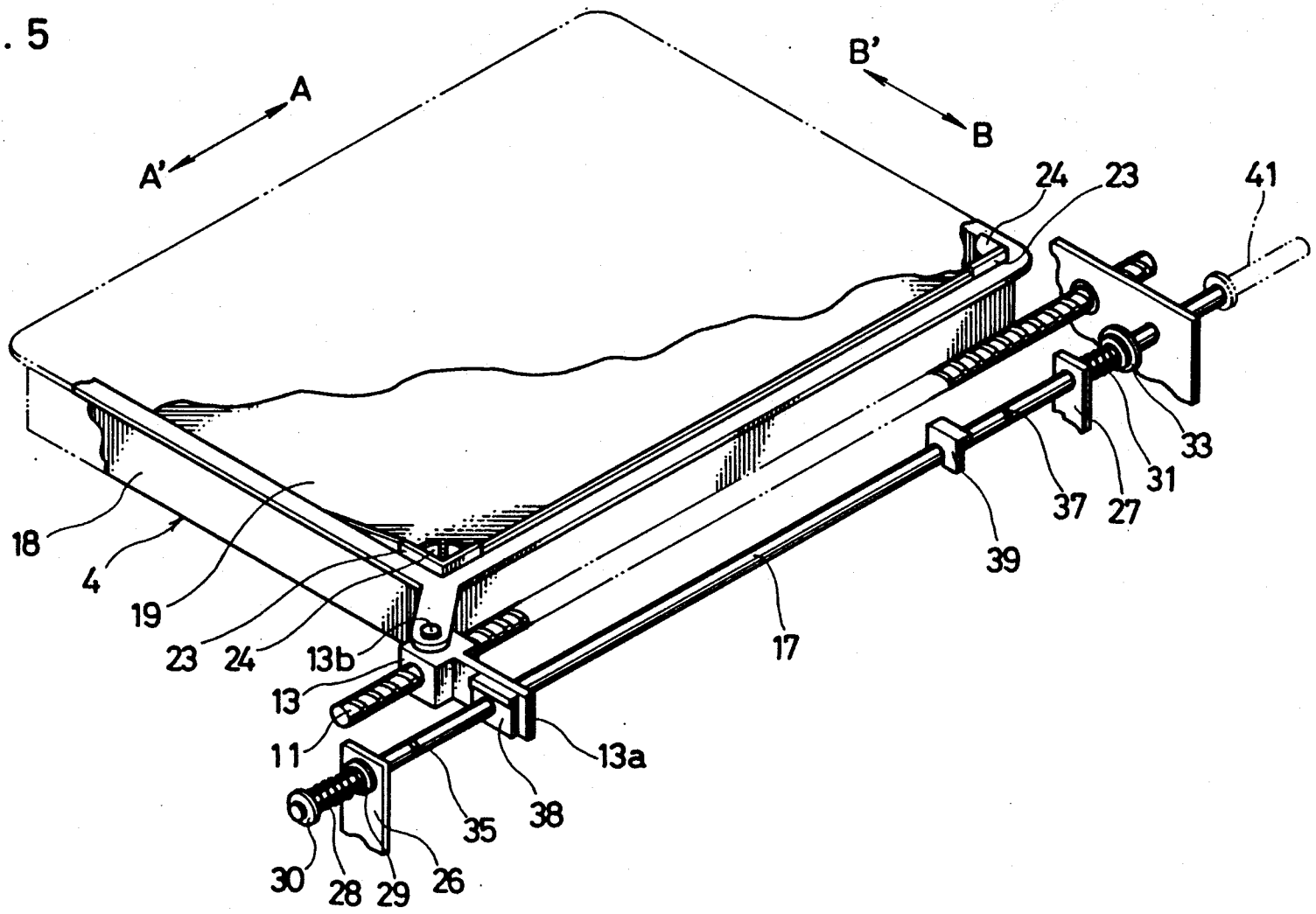

As also shown in FIG. 5, a shaft drive plate 13*a* is fixed to the movable joint 13 as a shaft drive member. Through the shaft drive plate 13*a*, is inserted a shifting shaft 17 as a shifting shaft member, which is disposed in the tray housing 3 at the end portion on the direction B side, adjacent to the rotative threaded shaft 11, in a direction parallel to the rotative threaded shaft 11.

As shown in FIG. 1, the rotatable paper tray 4 has a paper holding plate 19 disposed in an outside case 18. The paper holding plate 19 is supported to the outside case 18 solely by a support part 20 formed on one corner of the rotatable paper tray 4 diagonally opposite to the connecting part of the movable joint 13.

Further, the paper holding plate 19 is supported by the longitudinal feeding support part 21 and the lateral feeding support part 22 at the end portions thereof in the B' direction that are the opposite sides to feeding directions (B direction) in which sheets of paper are longitudinally or laterally fed. Here, the paper holding plate 19 is permitted to pivot or slide freely downward or upward.

The paper holding plate 19 is arranged so that when the rotatable paper tray 4 is located in either a lateral feeding position shown in FIG. 1 or a longitudinal feeding position shown in FIG. 2, it is driven by a paper holding plate lifting mechanism, not shown, and lifted in the respective end portions on the direction B side so as to permit a paper feeding operation.

In the outside case 18 of the rotatable paper tray 4, are disposed three paper-position setting plates 23 for setting a position of the sheets of paper. To those paper-position setting plates 23, are attached respective claw members 24 that are permitted to freely slide upward and downward for stopping the corners of the sheets of paper. The portions having the claw members 24 attached thereto correspond to both end corners of the sheets of paper at the direction B side when the rotatable paper tray 4 is disposed in either the longitudinal or lateral feeding position.

Further, one end of a rotation support plate 50 is coupled to the rear surface of the outside case 18, and the other end of the rotation support plate 50 is coupled to a mounting plate 25 disposed on the tray housing 3. The installation position of the paper-position setting plates 23 to the outside case 18, that of the rotation support plate 50 to the outside case 18 and that of the mounting plate 25 to the tray housing 3 can be changed depending on the size of sheets of paper stored in the rotatable paper tray 4. In the rotatable paper tray unit 1 of the present embodiment, sheets of paper can be selected from the sizes, A-4 and B-5.

The shifting shaft 17 is supported by a bearing member 26 disposed on the direction A' side of the tray housing 3 and a bearing member 27 disposed at the direction A side thereof, and permitted to freely slide. A coil spring 28 and washers 29 and 30 disposed respective sides of the coil spring 28 are fixed to the shifting shaft 17 at the bearing member 26 at the direction A' side. The washer 30 situated at the direction A' side is stopped by an end portion of the shifting shaft 17.

Similarly, a coil spring 31 and washers 32 and 33 are fixed to the shifting shaft 17 at the bearing member 27 at the direction A side, and the washer 33 situated at the direction A side is secured to the shifting shaft 17. Accordingly, the coil springs 28 and 32 as elastic members are adapted to dispose the shifting shaft 17 at a predetermined position where the both coil springs 28 and 32 balance each other.

Figure 6:
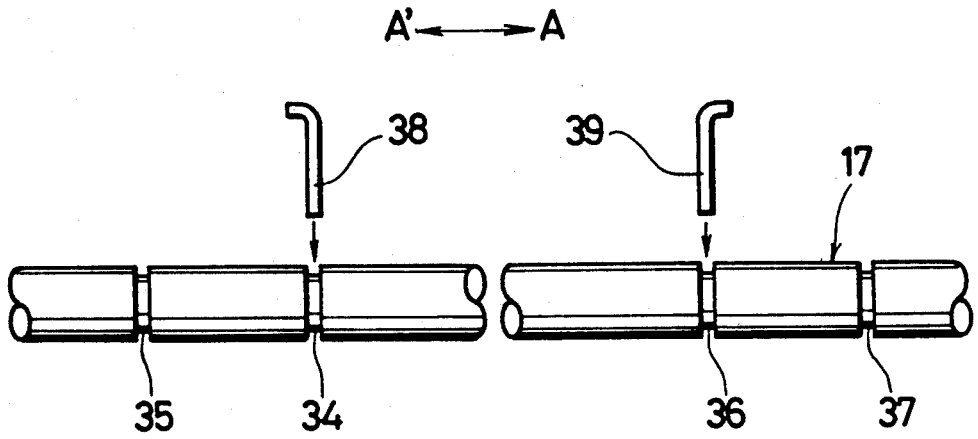

As illustrated in FIG. 6, on the shifting shaft 17 between the bearing members 26 and 27, is formed an engaging member fixing groove 34 for B-5 lateral feed at direction A' side, while an engaging member fixing groove 35 for A-4 lateral feed is formed with a predetermined distance from the former groove at the direction A' side. On the other hand, an engaging member fixing groove 36 for B-5 longitudinal feed is formed at the direction A side, and an engaging member fixing groove 37 for A-4 longitudinal feed is formed with a predetermined distance from the former groove at the direction A side.

In the case of rotating the rotatable paper tray 4 with B-5 sheets of paper to the lateral feeding position, an engaging member 38 for sliding the shifting shaft 17 in the A' direction after being depressed by the shaft drive plate 13*a* of the movable joint 13*a* is fitted to the engaging member fixing groove 34 for B-5 lateral feed. Similarly, in the case of rotating the rotatable paper tray 4 with B-5 sheets of paper to the longitudinal feeding position after being depressed by the shaft drive plate 13*a*, an engaging member 39 for sliding the shifting shaft 17 in the A direction is fitted to the engaging member fixing groove 36 for B-5 longitudinal feed.

Those grooves 34 to 37 are formed for properly actuating the shifting shaft 17 by replacing the positions of the engaging members 38 and 39 among the grooves 34 to 37 in the case of changing the size of sheets of paper.

More specifically, for example, in the case of changing the size of paper from B-5 to A-4 size, the installation positions of the paper-position setting plates 23 to the outside case 18, the rotation support plate 50 to the outside case 18 and the mounting plate 25 to the tray housing 3 are changed to other positions suitable for A-4 size so as to keep a center of paper feeding unchanged. At this time, stop positions of the movable joint 13 are changed in both of the cases where the rotatable paper tray 4 is located in the longitudinal and lateral feeding positions. Therefore, by shifting the engaging member 38 from the engaging member fixing groove 34 for B-5 lateral feed to the engaging member fixing groove 35 for A-4 lateral feed while shifting the engaging member 39 from the engaging member fixing groove 36 for B-5 longitudinal feed to the engaging member fixing groove 37 for A-4 longitudinal feed, the shifting shaft 17 can be properly actuated.

Figure 7:
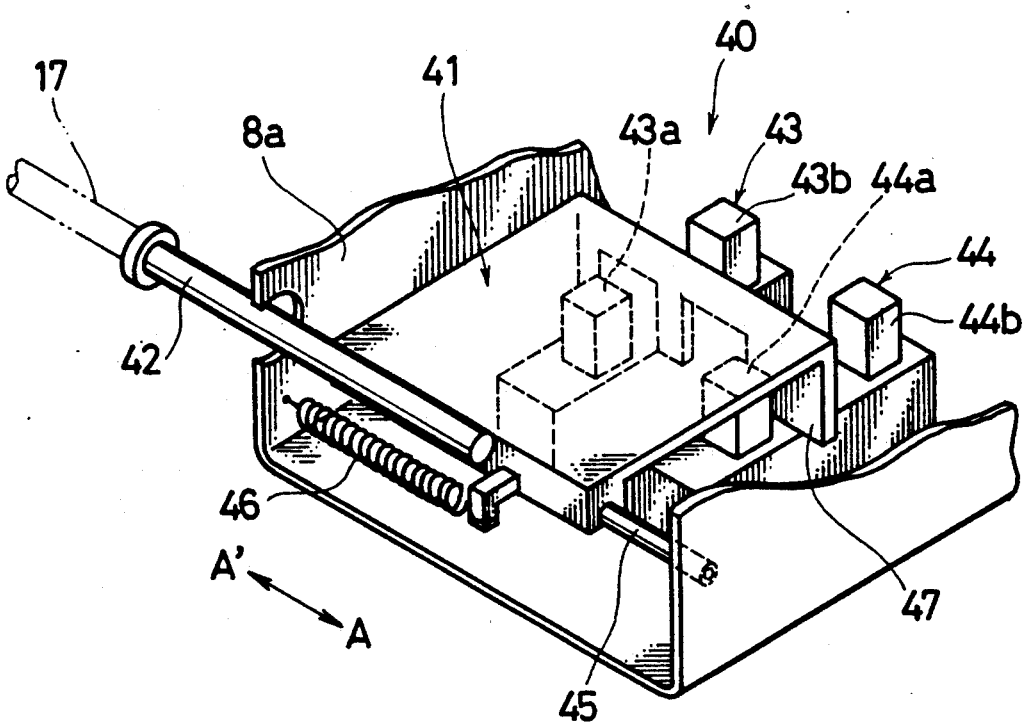

As illustrated in FIG. 4 and FIG. 7, a shiftable rod 42 of a light interrupting plate 41 in a sensor unit 40 as detection means is forced to come into contact with an end of the shifting shaft 17 at the direction A side. The sensor unit 40 is installed in a reducing mechanism frame 8a below the reducing mechanism 8, and provided with the light interrupting plate 41 as an action plate member and a first and second sensors 43 and 44 as switching means.

The light interrupting plate 41 is permitted to slide in the A—A' directions along a guiding rod 45 secured to the reducing mechanism frame 8*a* in the A—A' direction. A tension spring 46 is disposed between the light interrupting plate 41 and a wall of the reducing mechanism frame 8*a* at the A' side, and thus the shiftable rod 42 is forced to come into contact with the shifting shaft 17.

Figure 8:
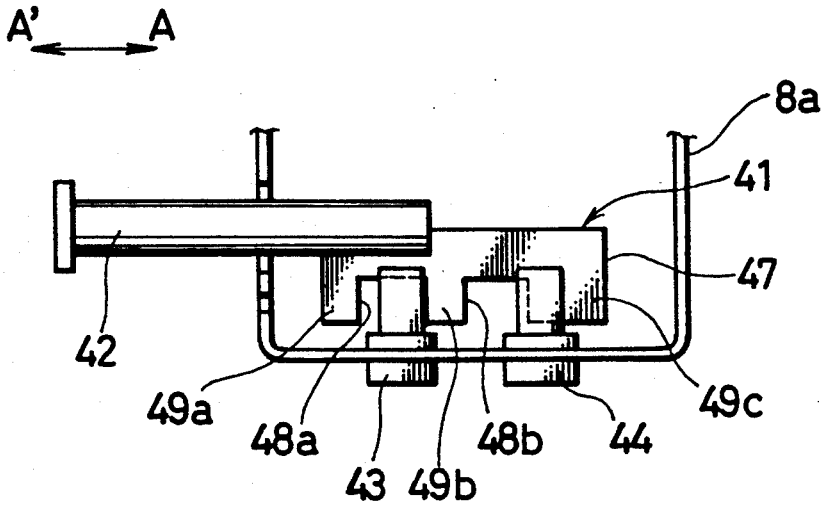
Figure 8:
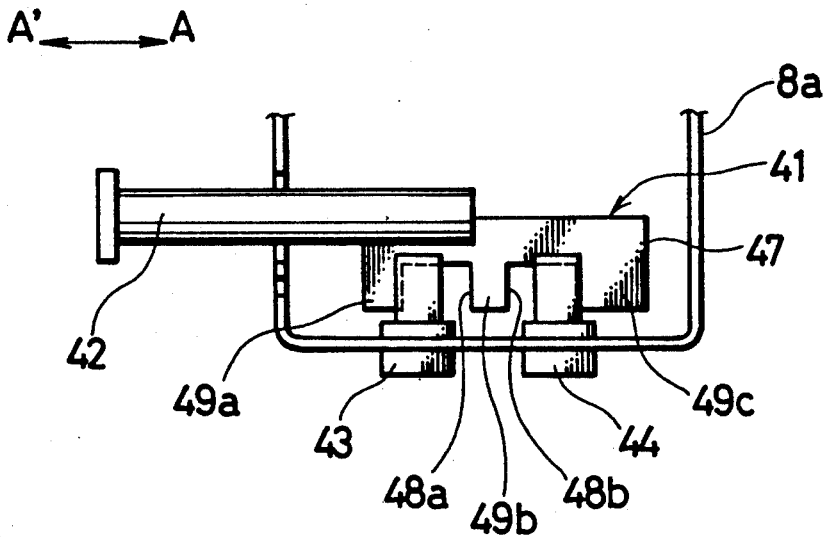
Figure 8:
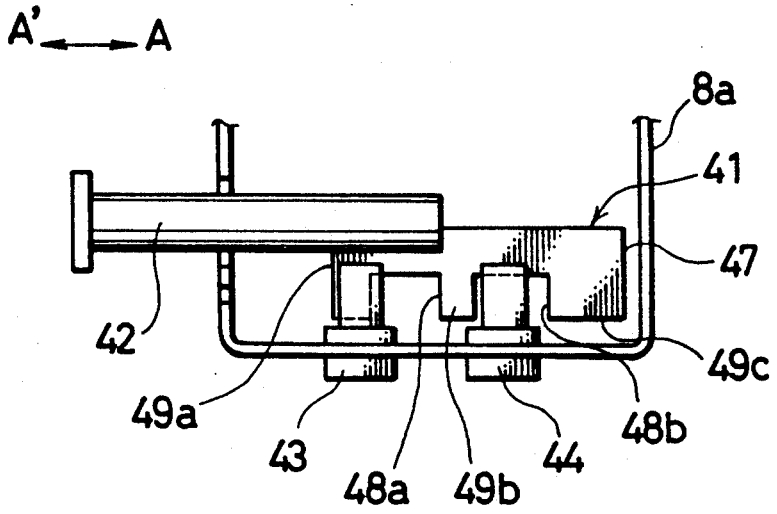
Figure 8:
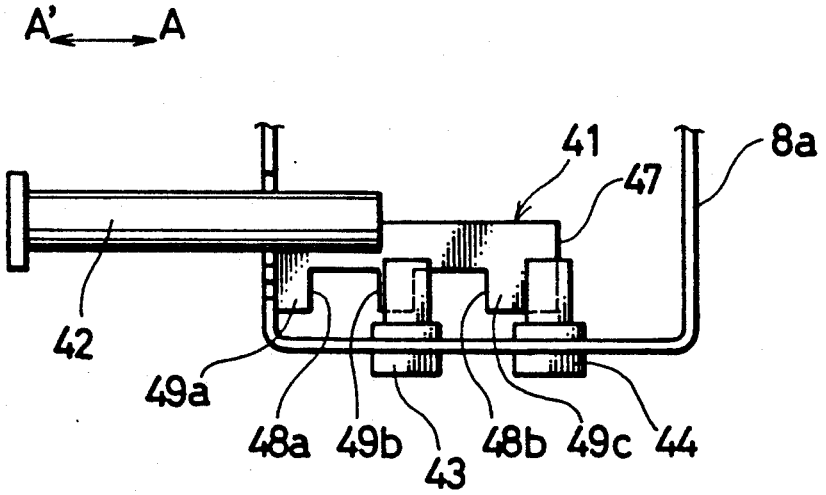

The light interrupting plate 41 is provided with a downward projecting wall 47. As illustrated in FIG. 8(*a*), a first and second notched portions 48*a* and 48*b* are formed in the downward projecting wall 47, thereby providing a first through third light interrupting portions 49*a* through 49*c* at both sides thereof.

The light interrupting plate 41 is brought to respective states illustrated by FIGS. 8(*a*) through 8(*d*), by shifting movements of the shifting shaft 17 caused by depressing actions of the shaft drive plate 13*a* of the movable joint 13 to the respective engaging members 38 and 39 depending on respective states of the rotatable paper tray 4 where it is located in the lateral feeding position; it is in rotation; and it is located in the longitudinal feeding position, and by a release of the depressing action of the shifting shaft 17 from the shiftable rod 42 in the case where the rotatable paper tray unit 1 is removed from the feeding device main body 2.

The first and second sensors 43 and 44 are optical sensors composed of, for example, light emitting elements 43*a* and 44*a*, and light receiving elements 43*b* and 44*b*. The sensor 43 is ON when a light path between the elements 43*a* and 43*b* is maintained through the notched portion 48*a* while the sensor 44 is ON when a light path between the elements 44*a* and 44*b* is maintained through the notched portion 48*b*. On the other hand, the sensors 43 and 44 are OFF when the light paths between those elements are interrupted by the respective first, second and third light interrupting portions 49*a*, 49*b* and 49*c*.

In the above arrangement, when the rotatable paper tray unit 1 is attached to the feeding device main body 2, the rotative threaded shaft 11 is engaged by the coupling clutch 10, and permitted to rotate by power of the motor 5. Further, the shiftable rod 42 of the light interrupting plate 41 is depressed by the shifting shaft 17.

At this time, if the rotatable paper tray 4 is located in the lateral feeding position as shown in FIG. 1, the engaging member 38 is depressed in the A' direction by the shaft drive plate 13*a* of the movable joint 13, and thus the shifting shaft 17 is slid in the A' direction, thereby causing the shiftable rod 42 to advance in the A' direction, as illustrated in FIG. 8(*a*). Thus, the first notched portion 48*a* of the light interrupting plate 41 is positioned in the light path of the first sensor 43 while the third light interrupting portion 49*c* is positioned in the light path of the second sensor 44. Accordingly, as shown in Table 1, the first sensor 43 is ON, while the second sensor 44 is OFF.

TABLE 1

| First Sensor ON/OFF | Second Sensor ON/OFF | State of Rotatable Paper Tray | Presence or Absence of Tray Unit |
|---|---|---|---|
| ON | OFF | lateral posit. | presence |
| ON | ON | rotating | |
| OFF | ON | logitu. posit. | |
| OFF | OFF | — | absence |

Next, when the rotatable paper tray 4 is in rotation after having started rotating from the lateral feeding position to the longitudinal feeding position, the shaft drive plate 13*a* of the movable joint 13 is moved in the A direction away from the engaging member 38. Thus, the shifting shaft 17 is permitted to slide in the A direction to recover a distance by which the shifting shaft 17 has been forced to move by the shaft drive plate 13*a*, thereby causing the shiftable rod 42 to retreat slightly in the A direction from the position shown by FIG. 8(*a*) as is illustrated in FIG. 8(*b*). Then, the first notched portion 48*a* of the light interrupting plate 41 is positioned in the light path of the first sensor 43 while the second notched portion 48*b* is positioned in the light path of the second sensor 44. Accordingly, as shown in Table 1, both the first and second sensors 43 and 44 are ON.

Thereafter, when the rotatable paper tray 4 is further rotated to reach the longitudinal feeding position as shown in FIG. 2, the engaging member 39 is depressed in the A direction by the shaft drive plate 13*a* of the movable joint 13, and thus the shifting shaft 17 is slid in the A direction, thereby causing the shiftable rod 42 to retreat farthest in the A direction, as illustrated in FIG. 8(*c*). Thus., the first light interrupting portion 49*a* of the light interrupting plate 41 is positioned in the light path of the first sensor 43 while the second notched portion 48*b* is positioned in the light path of the second sensor 44. Accordingly, as shown in Table 1, the first sensor 43 is OFF, while the second sensor 44 is ON.

On the other hand, in the case where the rotatable paper tray 4 is disposed, for example, in the lateral feeding position as shown in FIG. 1, if the rotatable paper tray unit 1 is removed from the feeding device main body 2 as shown in FIG. 3, the engagement between the rotative threaded shaft 11 and the coupling clutch 10 is released, and the shifting shaft 17 is separated from the shiftable rod 42. Thus, the depressing action of the shifting shaft 17 onto the shiftable rod 42 is released, thereby causing the shiftable rod 42 to advance farthest in the A' direction as is illustrated in FIG. 8(*d*). Consequently, the second light interrupting portion 49*b* of the light interrupting plate 41 is positioned in the light path of the first sensor 43 while the third light interrupting portion 49*c* is positioned in the light path of the second sensor 44. Accordingly, as shown in Table 1, both the first and second sensors 43 and 44 are OFF.

As described above, according to outputs from the first and second sensors 43 and 44, the feeding device of the present invention makes it possible to detect an operating condition of the rotatable paper tray 4, that is; whether it is in the longitudinal or lateral feeding position; and whether or not it is in rotation, as well as a state of presence or absence of the rotatable paper tray unit 1 in the feeding device main body 2.

Furthermore, in the case of changing the size of paper from B-5 to A-4 size, the detecting operation with respect to the rotatable paper tray 4 can be properly performed by resetting the engaging members 38 and 39 to the respective engaging member fixing groove 35 for A-4 lateral feed and engaging member fixing groove 37 for A-4 longitudinal feed. In the feeding device of the present invention, although the position of the movable joint 13 in conjunction with the longitudinal and lateral feeding positions of the rotatable paper tray 4 is changed depending on the size of sheets of paper to be used, the problem can be settled by resetting the positions of the engaging members 38 and 39. Therefore, it is not necessary to provide sensors for position detection of the rotatable paper tray 4 for all the sizes of paper to be used, resulting in the reduction of the number of parts.

As described above, a feeding device of the present invention has an arrangement wherein a shaft drive member moving together with the tray connecting point is attached to the transmission shaft member; a shifting shaft extending in a .shifting direction of the transmission shaft member, capable of freely moving in this direction, is installed in the vicinity of the transmission shaft member in a tray housing member; and an engaging member to be pressed by engaging the shaft drive member and an elastic member for urging the shifting shaft to be shifted at a predetermined position, are attached to the shifting shaft. On the other hand, in the feeding device main body, are installed detection means having an action plate making a forward or backward movement according to a movement of the shifting shaft driven by the shaft drive member and switching means turning ON or OFF according to a position of the action plate.

Therefore, the arrangement can eliminate a complicated wiring process of the harness which has been carried out by taking into account a removing operation of the rotatable paper tray unit from the feeding device main body, thereby simplifying the fabrication process of the rotatable paper tray. Further, a connector for connecting the harness to the feeding device main body is not required, thereby making it possible to reduce the number of the required parts.

Further, as described above, the feeding device of the present invention has an arrange wherein a shaft drive member moving together with the tray connecting point is attached to the transmission shaft member in a tray housing member; a shifting shaft extending in a shifting direction of the transmission shaft member, capable of freely moving in this direction, are installed in the vicinity of the transmission shaft member; and an engaging member to be pressed by engaging the shaft drive member and an elastic member for urging the shifting shaft to be shifted at a predetermined position. On the other hand, in the feeding device main body, is installed detection means including an action plate which makes a forward or backward movement according to a depressing action by the shifting shaft or a release of the depressing action taking place upon attaching or removing the rotatable paper tray unit to or from the feeding device main body while also making a forward or backward movement according to a movement of the shifting shaft driven by the shaft drive member, and switching means which turn ON or OFF according to a position of the action plate movement.

Thus, processing operations of harnesses can be simplified, and no connector is required, thereby making it possible to reduce the number of the required parts. Moreover, only one detection means can detect both a state of presence or absence of the rotatable paper tray unit in the feeding device main body and operating conditions of the rotatable paper tray, thereby making it possible to further reduce the number of the required parts.

Referring to FIGS. 9 through 13, the following description will discuss another embodiment of the present invention. For convenience of explanation, those of the members having the same functions and described in the first embodiment are indicated by the same reference numerals and the description thereof is omitted.

Figure 9:
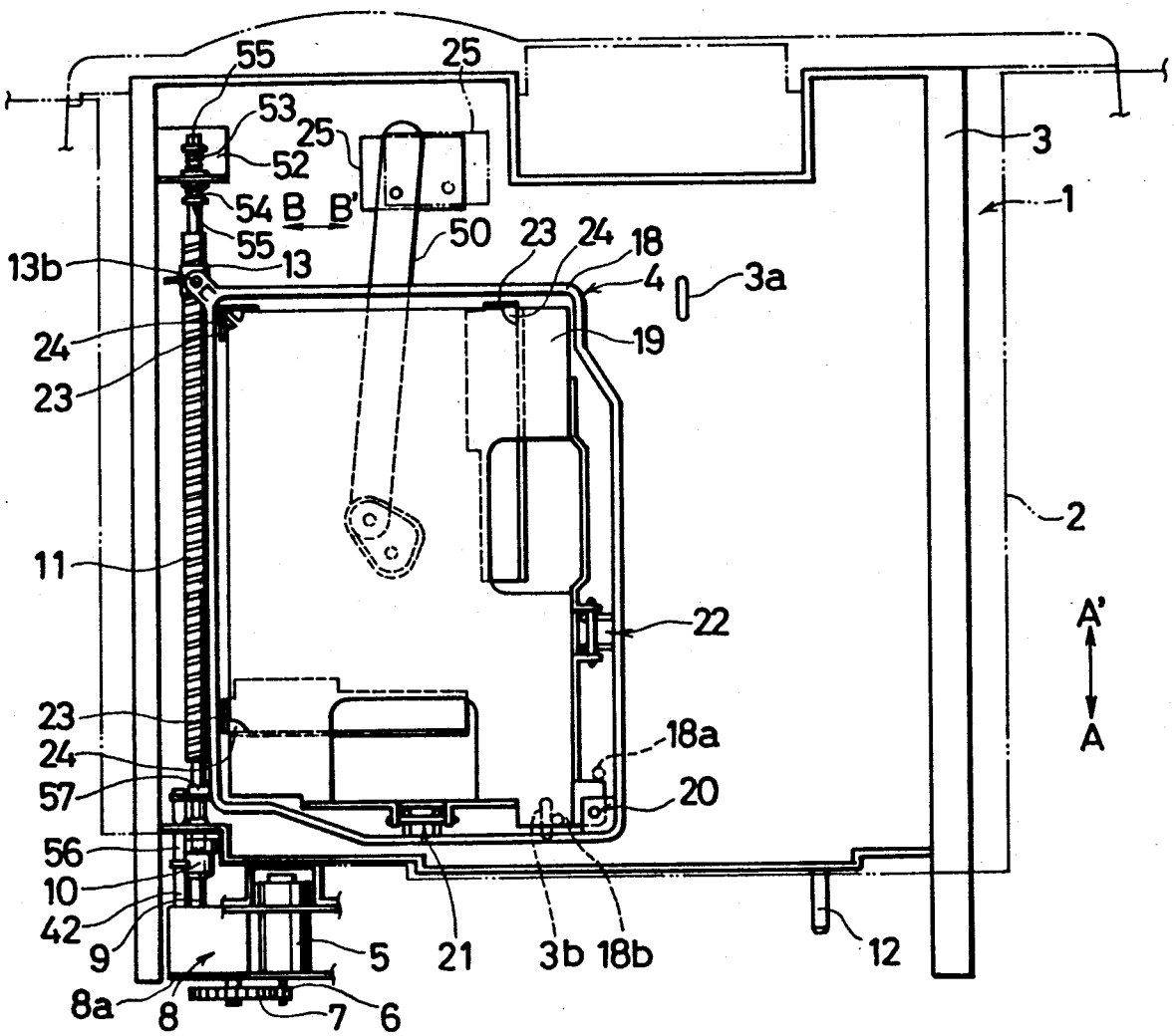
FIG. 9 through FIG. 13 show another embodiment of the present invention.
Figure 10:
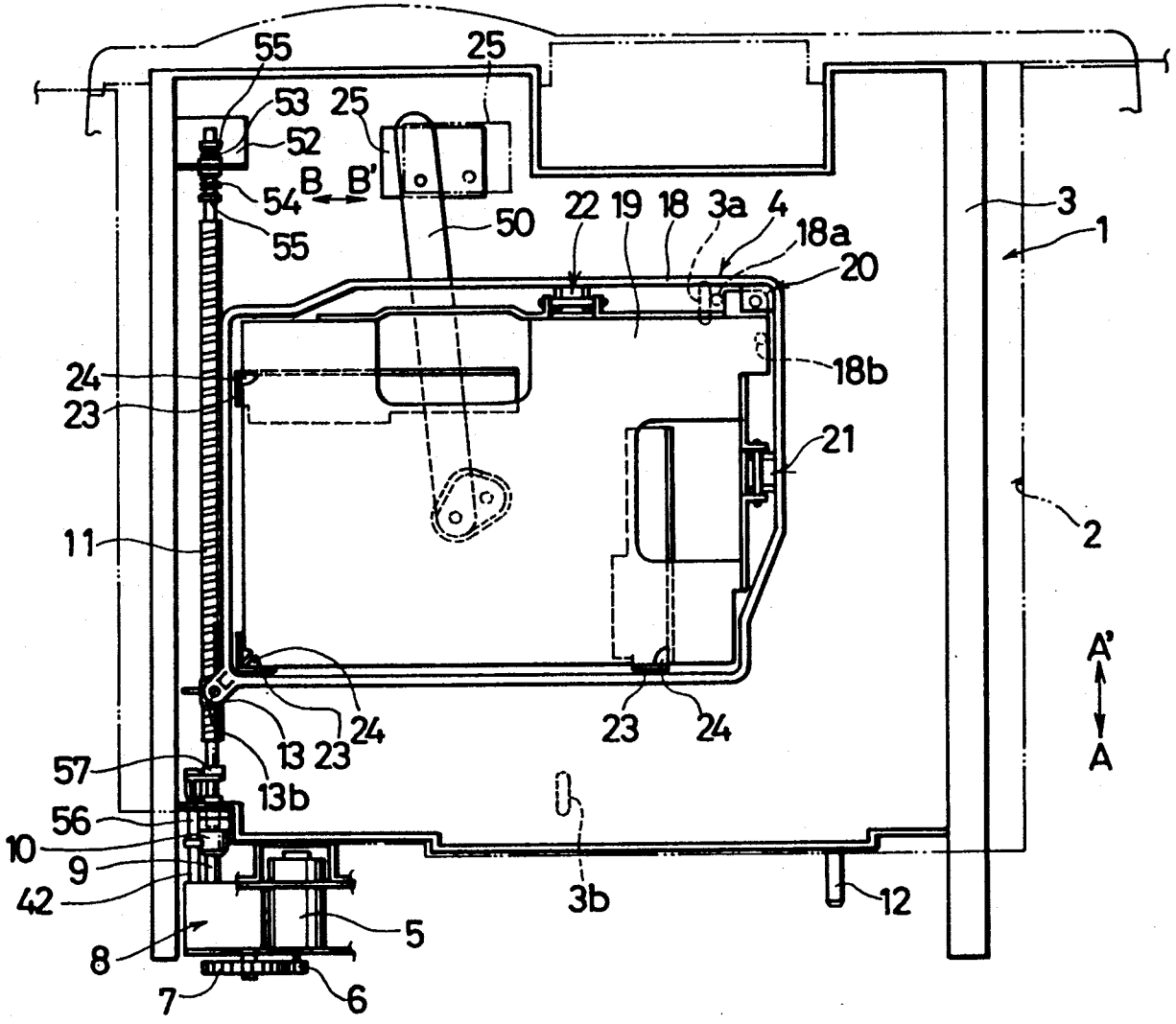
Figure 11:
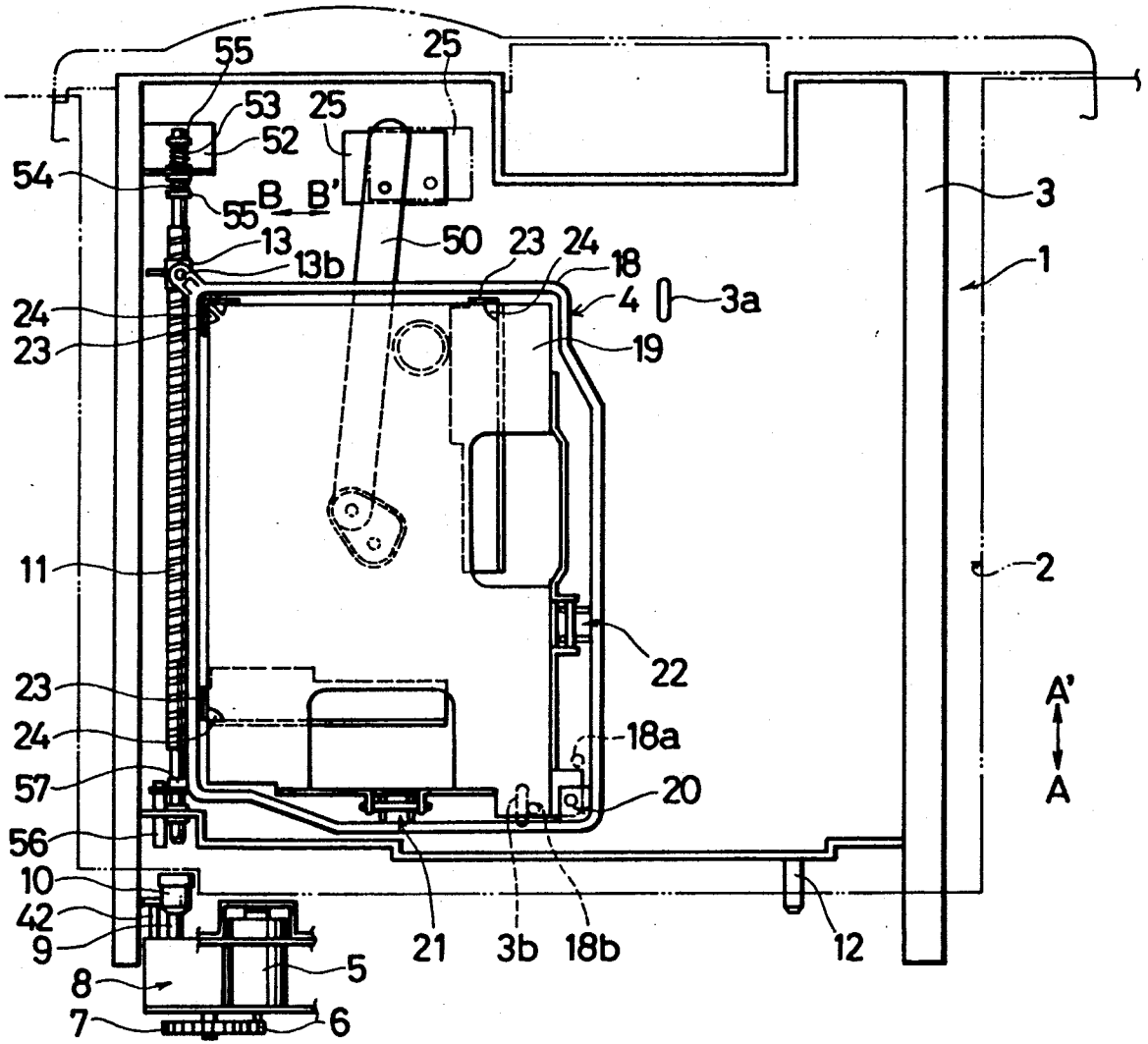

As illustrated in FIGS. 9 through 11, in a feeding device of the present invention, a longitudinal feeding position setting member 18*a* as an engaging section for setting a tray-side longitudinal feeding position (first engaging section for setting a longitudinal feeding position) and a lateral feeding position setting member 18*b* as an engaging section for setting a tray-side lateral feeding position (first engaging section for setting a lateral feeding position) are formed in the vicinity of the support part 20 on the rear surface of the outside case 18 of the rotatable paper tray 4. On the other hand, on the bottom surface of the tray housing 3, there are formed a longitudinal position setting member 3*a* as an engaging section for setting a housing-member-side longitudinal feeding position (second engaging section for setting a longitudinal feeding position), which sets the rotatable paper tray 4 in the longitudinal feeding position by engaging the longitudinal feeding position setting member 18*a* when the rotatable paper tray 4 is rotated to the longitudinal feeding position, and a lateral position setting member 3*b* as an engaging section for setting a housing-member-side lateral feeding position (second engaging section for setting a lateral feeding position), which sets the rotatable paper tray 4 in the lateral feeding position by engaging the lateral feeding position setting member 18*b* when the rotatable paper tray 4 is rotated to the lateral feeding position. Those longitudinal feeding position setting members 18*a* and 3*a*, and lateral feeding position setting members 18*b* and 3*b* are adapted to prevent a further rotating operation when the rotatable paper tray 4 is rotated to either the longitudinal or lateral feeding position.

Figure 12C:
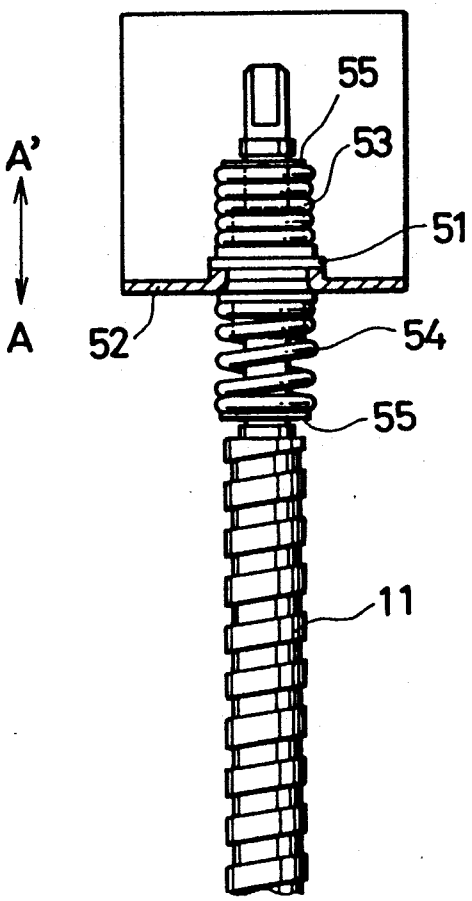
Figure 12B:
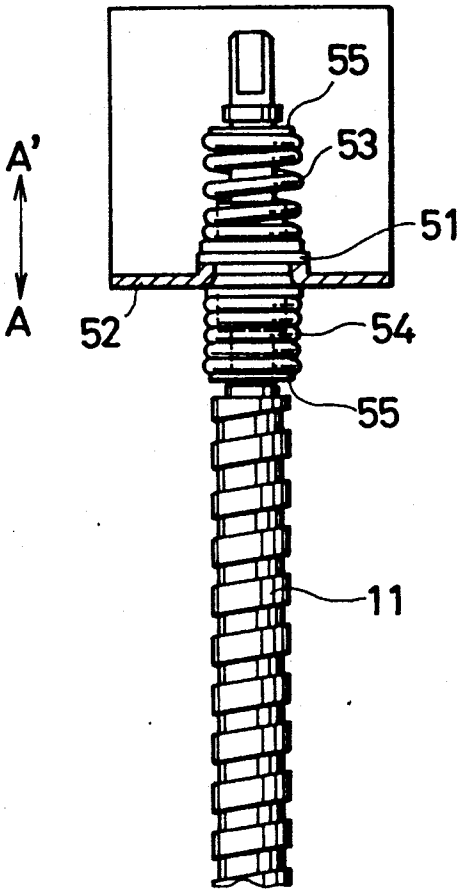
Figure 12A:
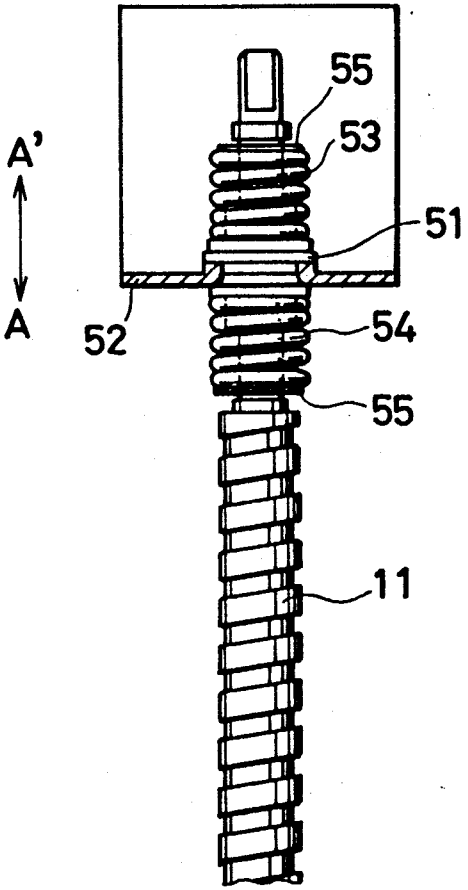

Further, as illustrated in FIGS. 12(*a*) through 12(*c*), in the vicinity of an end portion at the direction A' side of the rotative threaded shaft 11 as a rotative threaded member, the rotative threaded shaft 11 is rotatably supported by a shaft support plate 52 through a bearing member 51 so that it can freely slide in the A—A' directions. Compressed coil springs 53 and 54 are disposed at both sides of the bearing member 51, and an end at the direction A' side of the compressed coil spring 53 and an end at the direction A side of the compressed coil spring 54 are respectively fixed to the rotative threaded shaft 11 by fixing members 55. Thus, the rotative threaded shaft 11 is allowed to make reciprocating movements in the A—A' directions within a range permitted by either the compressed spring 53 or 54.

Figure 13:
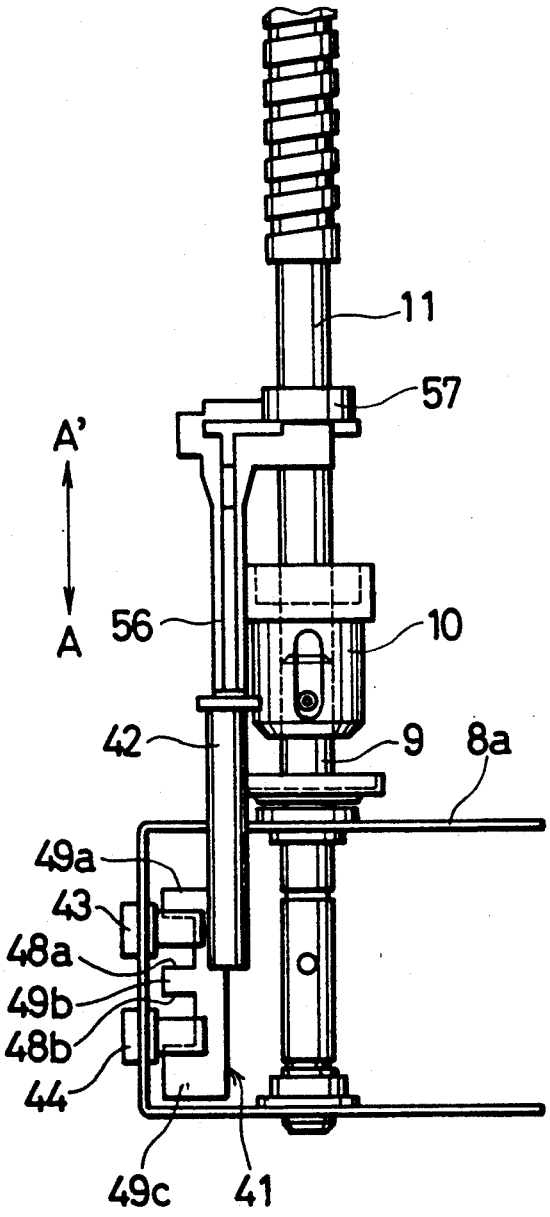
Figure 13:
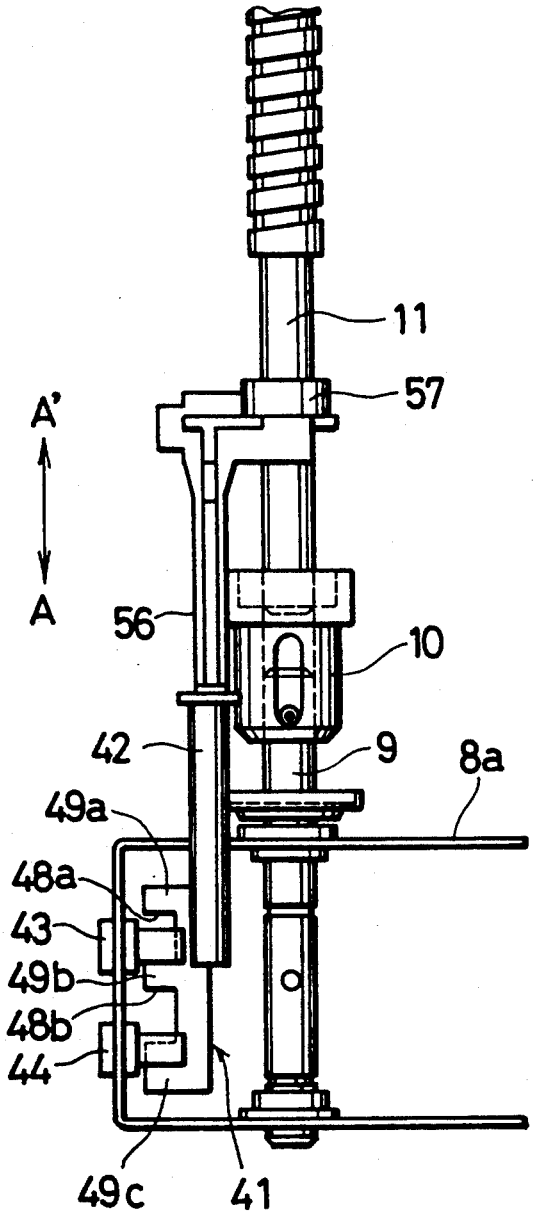
Figure 13:
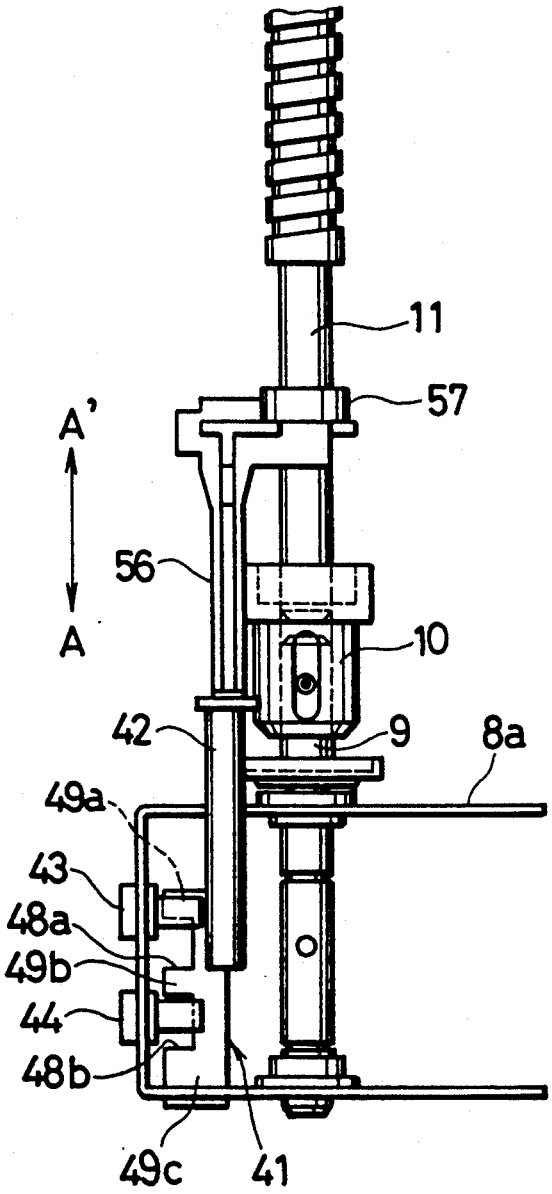
Figure 13:
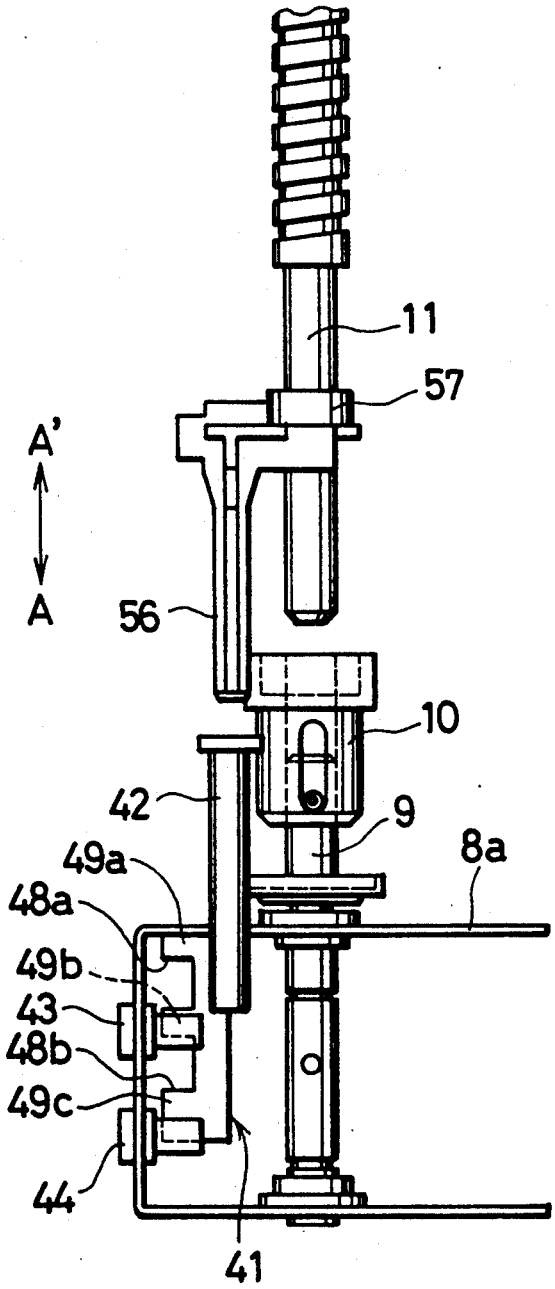

On the other hand, as illustrated in FIGS. 13(*a*) through 13(*d*), in the vicinity of an end portion at the direction A side of the rotative threaded shaft 11, a depressing member 56 (which will be described later) is coupled to the rotative threaded shaft 11 through a coupling member 57, and permitted to move with the rotative threaded shaft 11. As also illustrated in FIGS. 13(*a*) through 13(*c*), a shiftable rod 42 of a light interrupting plate 41 in a sensor unit 40 is forced to connect to an end portion at the direction A side of the depressing member 56 when the rotatable paper tray unit 1 is attached to the feeding device main body 2.

In the above arrangement, when the rotatable paper tray unit 1 is attached to the feeding device main body 2, the rotative threaded shaft 11 is engaged by the coupling clutch 10, and permitted to rotate by power of the motor 5. Further, the shiftable rod 42 of the light interrupting plate 41 is depressed by the depressing member 56.

If the rotatable paper tray 4 is in rotation, for example, from the longitudinal feeding position to the lateral feeding position, the rotative threaded shaft 11 is not shifted, and a balanced state of the compressed coils 53 and 54 is maintained, as illustrated in FIG. 12(*a*). At this time, as illustrated in FIG. 13(*a*), the shiftable rod 42 is depressed in the A direction by the depressing member 56, since such a positional relationship is predeterminately set in conjunction with the depressing member 56 and the shiftable rod 42 of the light interrupting plate 41 in the case where the rotatable paper tray unit 1 is attached to the feeding device main body 2. Accordingly, as shown in Table 1, both the first and second sensors 43 and 44 are ON.

Thereafter, as illustrated in FIG. 9, when the rotatable paper tray 4 reaches the lateral feeding position, the lateral position setting member 18*b* on the outside case 18 comes to engage the lateral position setting member 3*b* of the tray housing 3 in the rotatable paper tray 4, thereby permitting the rotatable paper tray 4 to be properly located in the lateral feeding position. The rotative threaded shaft 11 keeps rotating after the rotatable paper tray 4 has been properly located. Here, since the movable joint 13 is in a fixed state, the rotative threaded shaft 11 is shifted in the A' direction. Consequently, as illustrated in FIG. 12(*b*), the compressed coil spring 54 is compressed while the compressed coil spring 53 is extended, thereby making the shiftable rod 42 stick out in the direction A' more than the state in rotation, as is illustrated in FIG. 13(*b*). Accordingly, as shown in Table 1, the first sensor 43 is ON while the second sensor 44 is OFF.

Next, when the rotatable paper tray 4 is rotated from the lateral feeding position to the longitudinal feeding position to reach the longitudinal feeding position, as illustrated in FIG. 10, the longitudinal position setting member 18*a* on the outside case 18 comes to engage the longitudinal position setting member 3*a* of the tray housing 3, thereby permitting the rotatable paper tray 4 to be properly located in the longitudinal feeding position.

Similarly, in this case, since the rotative threaded shaft 11 keeps rotating after the rotatable paper tray 4 has been properly located, it is shifted in the A direction. Thus, as illustrated in FIG. 12(*c*), the compressed coil spring 54 is extended while the compressed coil spring 53 is compressed, thereby making the shiftable rod 42 retreat in the A direction more than the state in rotation, as is illustrated in FIG. 13(*c*). Accordingly, as shown in Table 1, the first sensor 43 is OFF while the second sensor 44 is ON.

On the other hand, in a state where the rotatable paper tray 4 is in the lateral feeding position as shown in FIG. 1, if the rotatable paper tray unit 1 is removed from the feeding device main body 2, the depressing member 56 is separated from the shiftable rod 42 as illustrated in FIG. 11. Thus, the depressing action of the depressing member 56 onto the shiftable rod 42 is released, thereby causing the shiftable rod 42 to advance farthest in the A' direction as is illustrated in FIG. 13(*d*).

Consequently, as shown in Table 1, both the first and second sensors 43 and 44 are OFF.

As described above, a feeding device of the present invention has the following arrangement. The rotative threaded member is supported so as to freely move in its shaft direction, and the rotative threaded member has a depressing member. The rotatable paper tray is provided with an engaging section for setting a tray-side lateral feeding position and an engaging section for setting a tray-side longitudinal feeding position. On the other hand, the tray housing member is provided with an engaging section for setting a housing-member-side lateral feeding position and an engaging section for setting a housing-member-side longitudinal feeding position, each of which has an operative relation with the respective engaging section for setting the tray-side longitudinal or lateral feeding position, and when the rotatable paper tray is to be positioned in either the longitudinal or lateral position, locates the rotatable paper tray in the respective position by engaging the respective engaging section for setting the tray-side longitudinal or lateral feeding position. Further, the feeding device main body is provided with detection means having an action plate which moves forward or backward according to a movement of the depressing member caused by the rotation of the rotative threaded member and with switching means which turn ON or OFF according to a position of the action plate.

Thus, processing operations of harnesses can be simplified, and no connector is required, thereby making it possible to reduce the number of the parts.

Furthermore, a feeding device of the present invention has the following arrangement. The rotative threaded member is supported so as to freely move in its shaft direction, and the rotative threaded member has a depressing member. The rotatable paper tray is provided with an engaging section for setting a tray-side lateral feeding position and an engaging section for setting a tray-side longitudinal feeding position. On the other hand, the tray housing member is provided with an engaging section for setting a housing-member-side lateral feeding position and an engaging section for setting a housing-member-side longitudinal feeding position, each of which has an operative relation with the respective engaging section for setting the tray-side longitudinal or lateral feeding position, and when the rotatable paper tray is to be positioned in either the longitudinal or lateral position, locates the rotatable paper tray in the respective position by engaging the respective engaging section for setting the tray-side longitudinal or lateral feeding position. On the other hand, in the feeding device main body, there are installed detection means having an action plate which makes a forward or backward movement according to a depressing action by the depressing member or a release of the depressing action taking place upon attaching or removing the rotatable paper tray unit to or from the feeding device main body while also making a forward or backward movement according to a movement of the depressing member given by the rotation of the rotative threaded member, and switching means which turns ON or OFF according to a position of the action plate movement.

Thus, processing operations of harnesses can be simplified, and no connector is required, thereby making it possible to reduce the number of the parts. Further, as with the feeding device of claim 2, the same detection means can detect both a state of presence or absence of the rotatable paper tray unit in the feeding device main body and operating conditions of the rotatable paper tray, thereby making it possible to further reduce the number of required parts.

Figure 14:
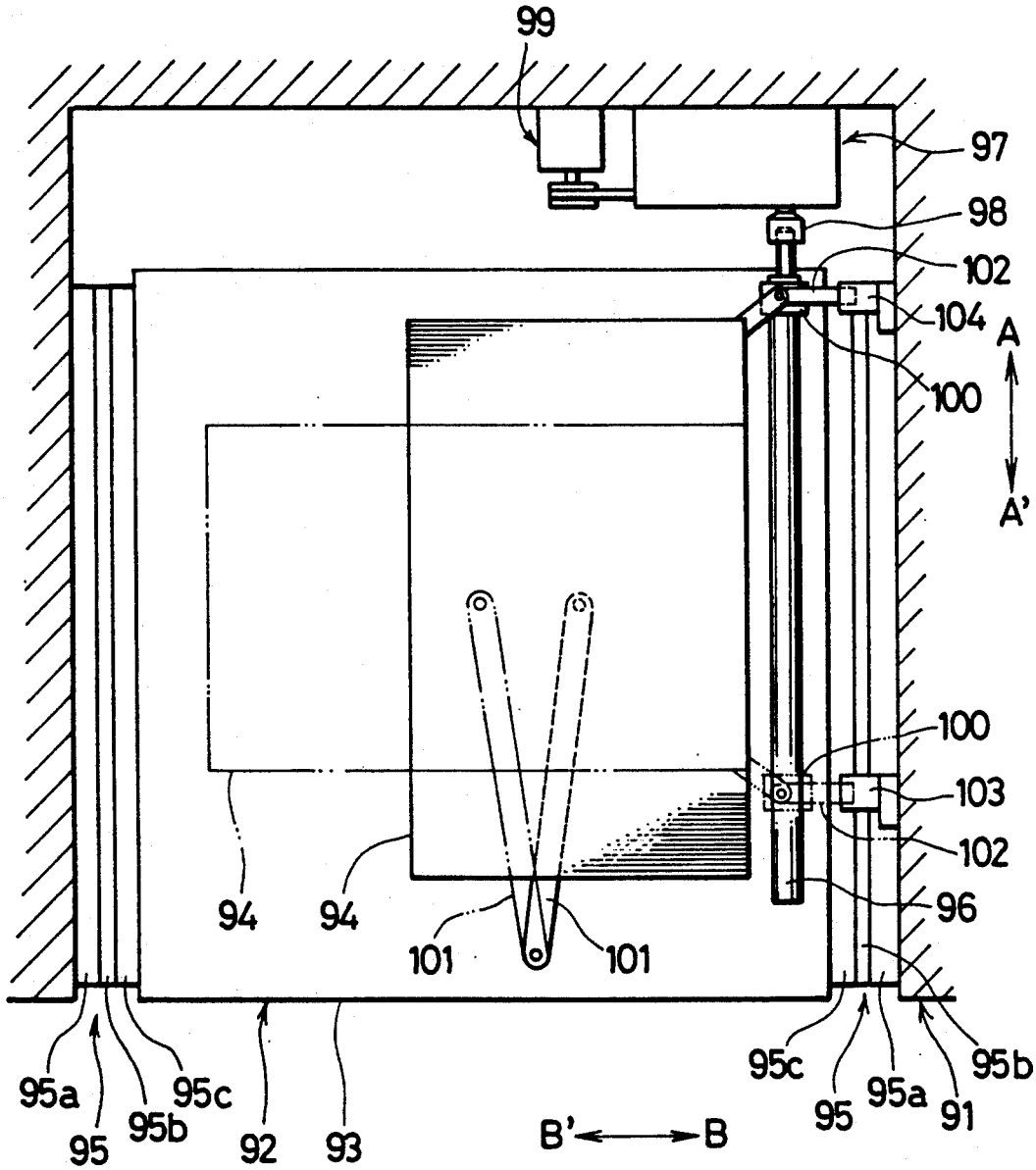
FIG. 14 and FIG. 15 show still another embodiment of the present invention.
Figure 15:
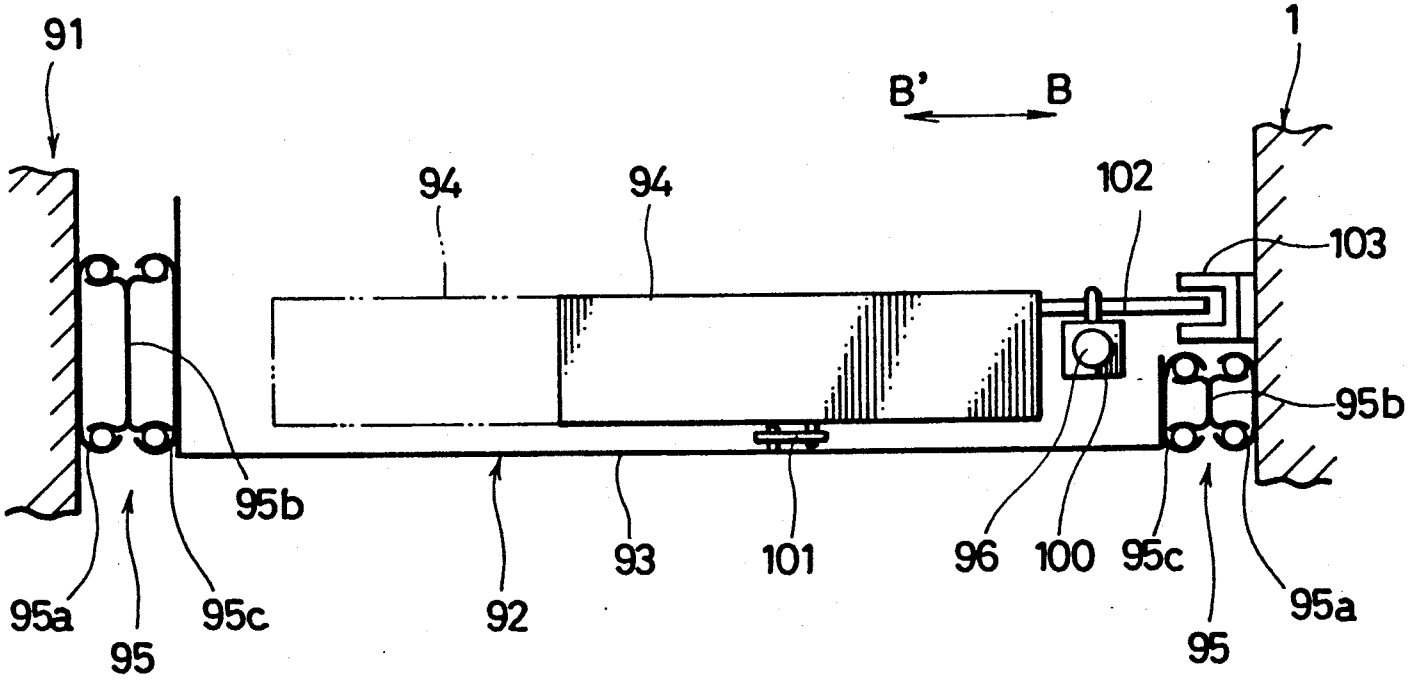
Figure 16:
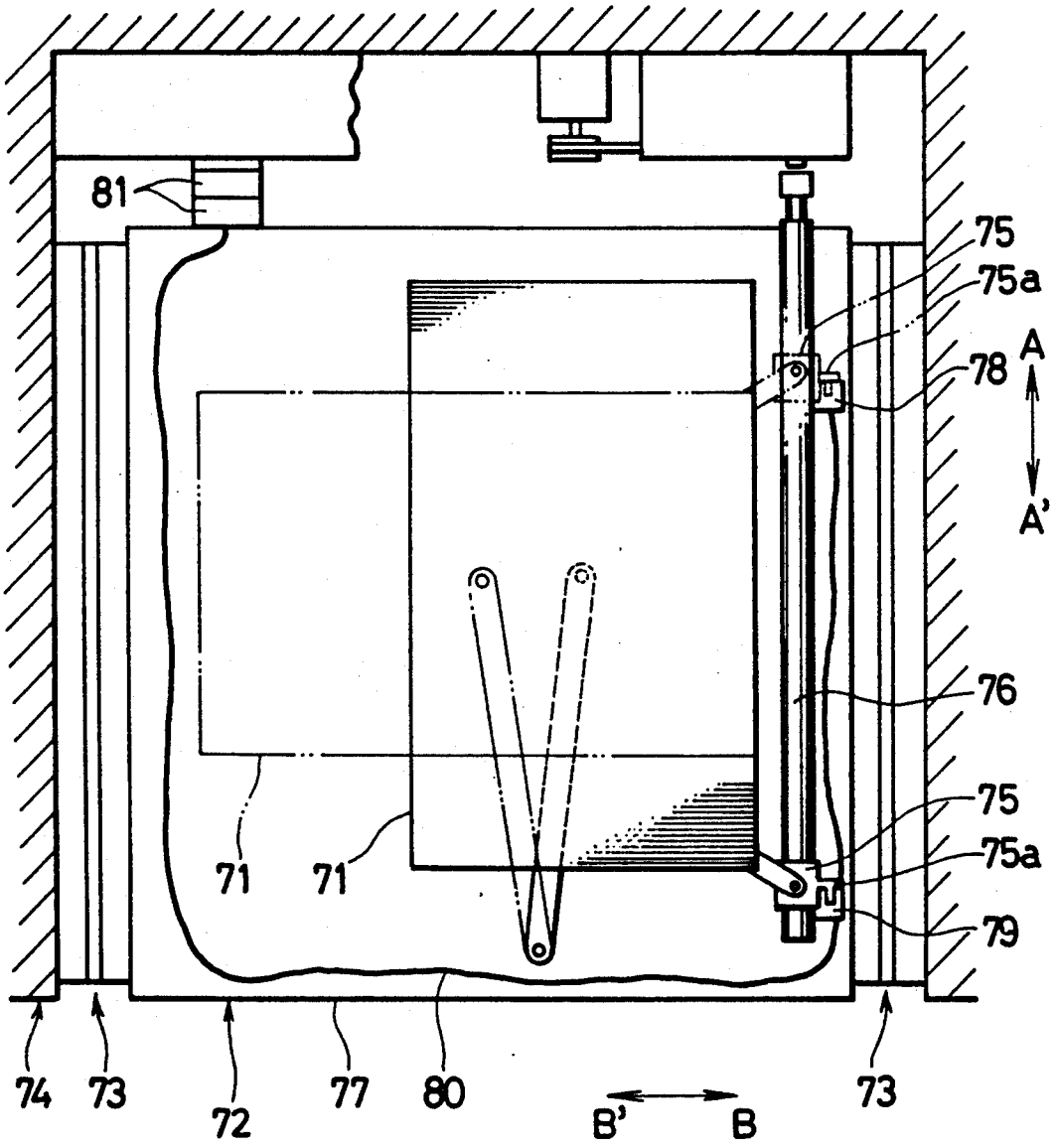
FIG. 16 PRIOR ART
FIG. 16 through FIG. 20 show the prior art.
Figure 17:
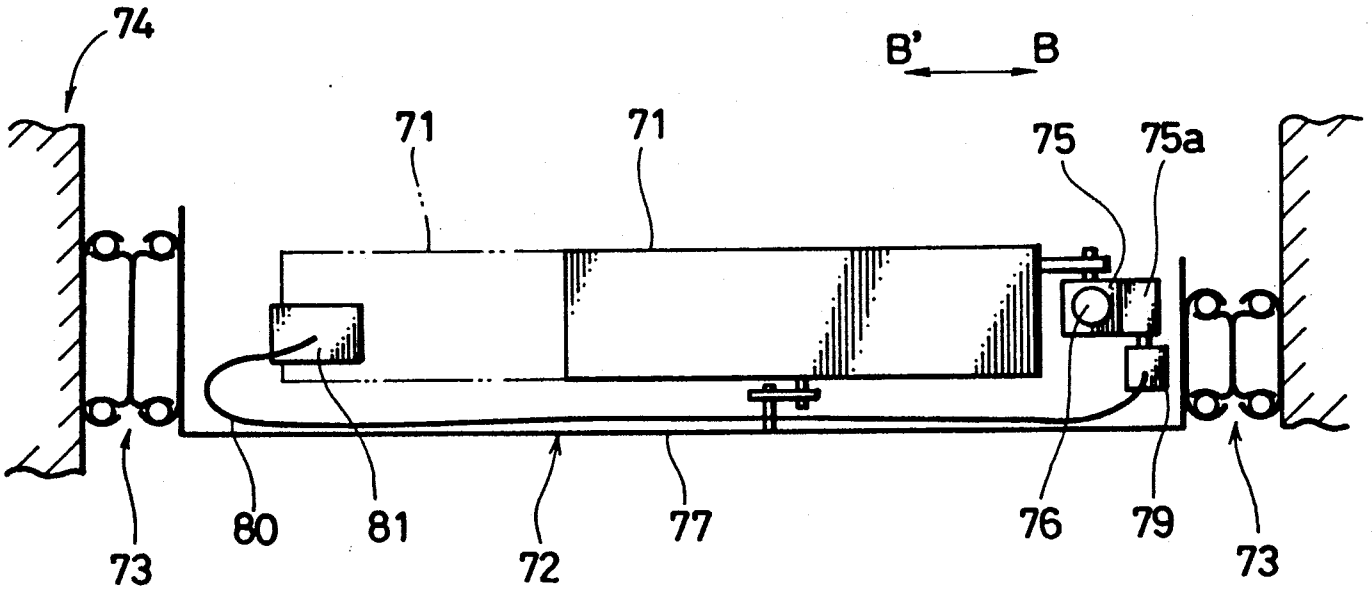
FIG. 17 PRIOR ART
Figure 18:
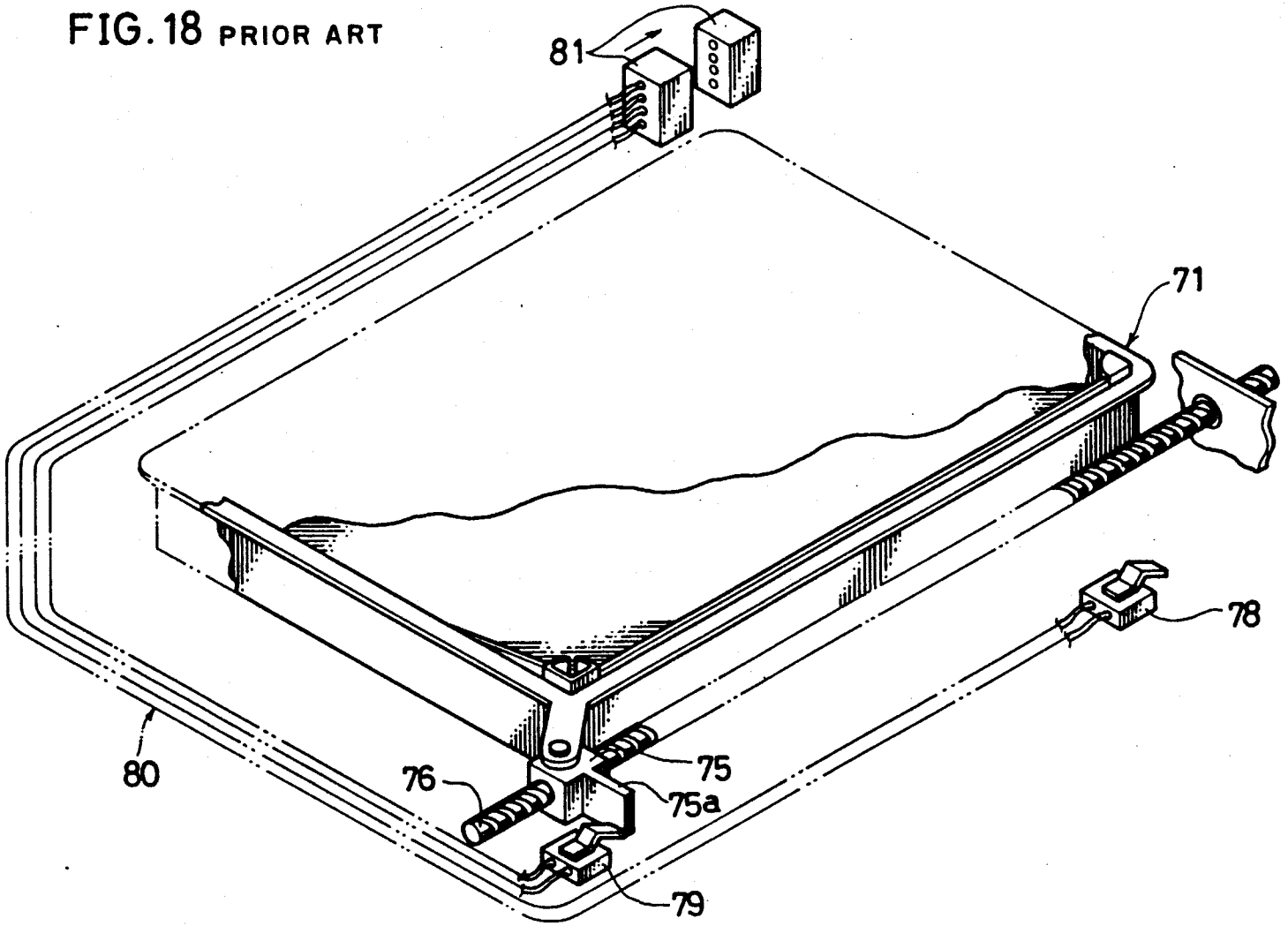
FIG. 18 PRIOR ART
Figure 19:
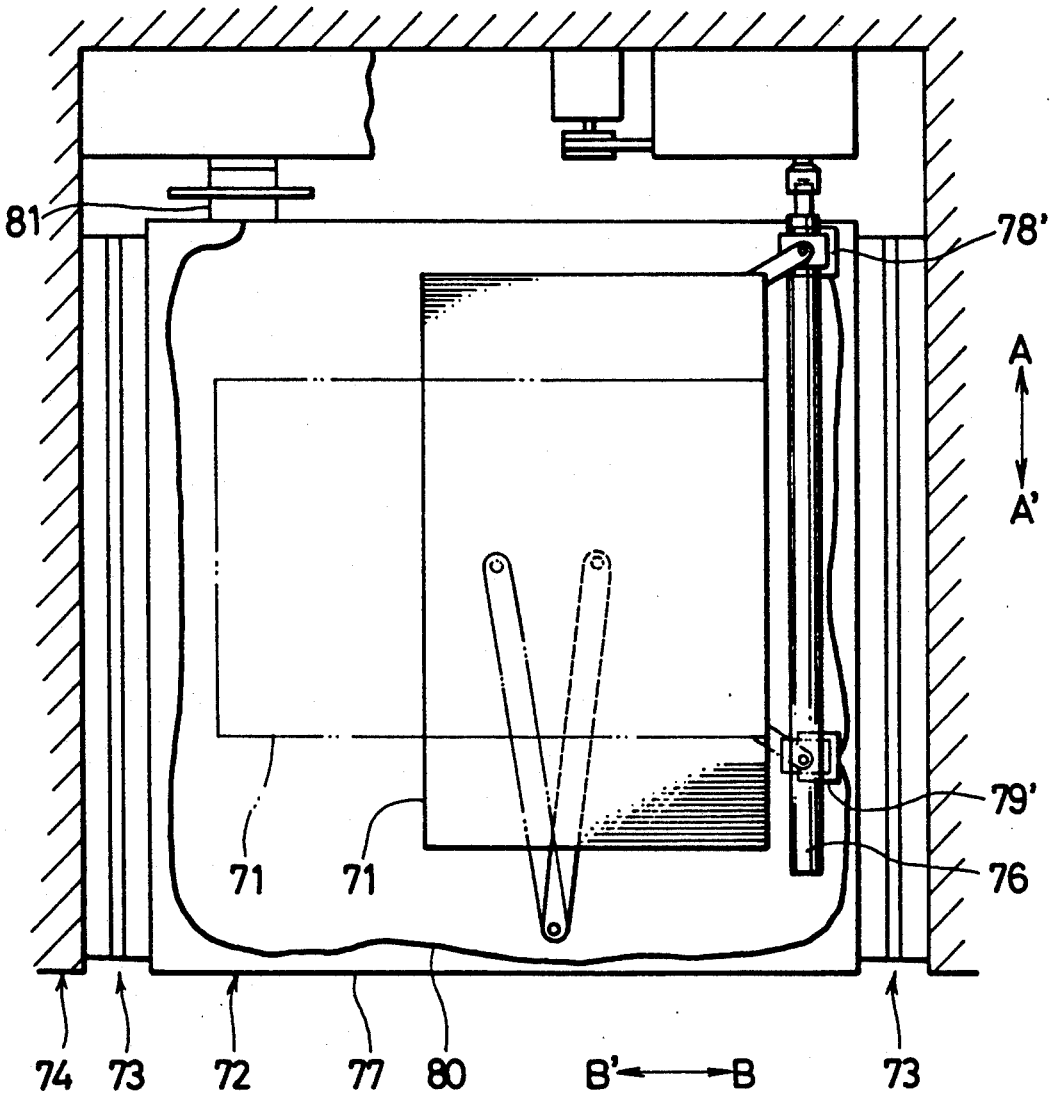
FIG. 19 PRIOR ART
Figure 20:
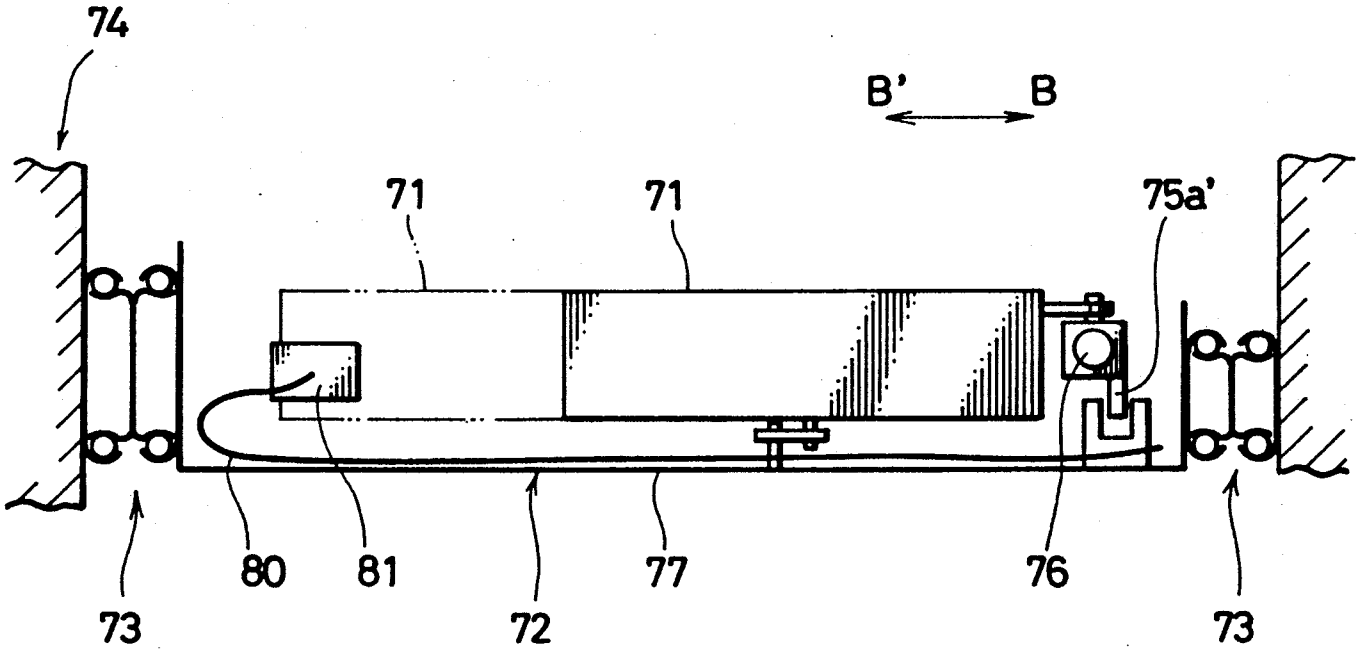
FIG. 20 PRIOR ART

Referring to FIG. 14 and FIG. 15, the following description will discuss another embodiment of a feeding device wherein position sensors for detecting a position of a rotatable paper tray whether it is in the longitudinal or lateral feeding position are installed in the feeding device main body.

As illustrated in FIG. 14 and FIG. 15, for example, the feeding device is provided with a feeding device main body 91 and a rotatable tray unit 92. The rotatable paper tray unit 92 contains a rotatable paper tray 94 in a tray housing 93. A sliding mechanism 95 for supporting the rotatable paper tray unit 92 to the feeding device main body 91 so as to permit it to slide freely, is disposed between the tray housing 93 and the feeding device main body 91.

The sliding mechanism 95 has a main-body member **95*a*, an intermediate member 95*b* and a drawer member 95*c*. The intermediate member 95*b* and the drawer member 95*c* are adapted to slide on the main-body member 95*a*. Thus, the rotatable paper tray unit 92 is permitted to freely slide in the A—A′ directions, that is, an attaching direction and a drawing direction of the rotatable paper tray unit 92 to and from the feeding device main body 91. A rotative threaded shaft 96 is installed in the A—A′ direction at the paper feeding side, that is, at the direction B side in the tray housing 93. An end portion at the direction A side of the rotative threaded shaft 96 projecting from the tray housing 93 is adapted to couple to a coupling clutch 98 of a reducing mechanism 97 when the rotatable paper tray unit 92 is attached to the feeding device main body 91. The reducing mechanism 97 reduces power of a motor 99, and transmits the power to the rotative threaded shaft 96**.

The rotative threaded shaft 96 is engaged by a movable joint 100 which is coupled to the rotatable paper tray 94 and permitted to move on the rotative threaded shaft 96 in response to the rotation of the rotative threaded shaft 96. One end of an arm 101 (rotation support plate) in the shape of an elongated plate is rotatably supported to a center portion of the rear surface of the rotatable paper tray 94, while the other end of the arm 101 is rotatably supported to the bottom surface of the tray housing 93. Thus, as the movable joint 100 moves, the rotatable paper tray 94, supported by the arm 101, is rotated between the lateral feeding position shown by a solid line and the longitudinal feeding position shown by an alternate long and two short dashes line.

Further, a light interrupting plate 102 is fixed to the movable joint 100, while a longitudinal feeding position sensor 103 and a lateral feeding position sensor 104, each including a light emitting element and a light receiving element, are installed in the feeding device main body 91.

The longitudinal feeding position sensor 103 is installed at a position where its light path is to be interrupted by the light interrupting plate 102 when the rotatable paper tray 94 is located in the longitudinal feeding position. Similarly, the lateral feeding position sensor 104 is installed at a position where its light path is to be interrupted by the light interrupting plate 102 when the rotatable paper tray 94 is located in the lateral feeding position. Those longitudinal and lateral feeding position sensors 103 and 104 are connected to a control device, not shown, for controlling the motor 99, etc. according to detection signals of the sensors 103 and 104, which is installed in the feeding device main body 91. The light interrupting plate 102 and the longitudinal and lateral feeding position sensors 103 and 104 constitute a rotatable paper tray longitudinal-lateral position detection device.

With the above arrangement, as illustrated in FIG. 14, when the rotatable paper tray unit 92 is attached to the feeding device main body 91, the rotative threaded shaft 96 is coupled to the coupling clutch 98 of the reducing mechanism 97, and brought into a rotatable state. Next, upon receiving an instruction for rotating the rotatable paper tray 94, the control device controls the motor 99 to rotate; the driving power is transmitted to the rotative threaded shaft 96 through the reducing mechanism 97; and the rotative threaded shaft 96 is permitted to rotate.

The movable joint 100 is thus moved on the rotative threaded shaft 96, making the rotatable paper tray 94 rotate to be located in either the longitudinal or lateral feeding position. Then, upon receiving the information that the rotatable paper tray 94 has reached either the longitudinal or lateral feeding position from the longitudinal or lateral feeding position sensor 103 or 104, the control device stops the motor 99, and in this state a feeding operation from the rotatable paper tray 94 is allowed.

On the other hand, in such operations as supplying or removing sheets of paper to or from the rotatable paper tray 94 in the rotatable paper tray unit 92, the rotatable paper tray unit 92 is drawn in the A' direction. At this time, the end portion of the rotative threaded shaft 96 is disconnected from the coupling clutch 98, thereby separating the rotative threaded shaft 96 from the reducing mechanism 97.

In the above arrangement, since the sensors 103 and 104 for detecting the longitudinal or lateral feeding position of the rotatable tray unit 92 to be drawn from the the rotatable paper tray unit 92 to be drawn from the feeding device main body 91, it is prevented to accidentally damage these sensors 103 and 104. Moreover, since no harness for connecting the sensors 103 and 104 to the feeding device main body 91 is required, a labor-consuming wiring process of the harness is eliminated, and further no connector for connecting the harness to the feeding device main body 91 is required.

As described above, a feeding device of the present invention has the following arrangement. A lateral feeding position sensor for detecting that the rotatable paper tray is located in the lateral feeding position and a longitudinal position sensor for detecting that the rotatable paper tray is located in the longitudinal position are installed in the feeding device main body.

Therefore, the arrangement can eliminate a complicated wiring process of the harness which has been carried out by taking into account a removing operation of the rotatable paper tray unit from the feeding device main body, thereby simplifying the fabrication process of the rotatable paper tray. Further, a connector for connecting the harness to the feeding device main body is not required, thereby making it possible to reduce the number of parts.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A feeding device comprising:

a feeding device main body;

a rotatable paper tray unit removably attached to said feeding device main body, including a tray housing member having a transmission shaft member and a rotatable paper tray, said rotatable paper tray being coupled to said transmission shaft member through a movable member moving on said transmission shaft member, said rotatable paper tray being rotated to change a feeding position responsive to a forward or backward movement of said movable member by said transmission shaft member; and detection means for detecting operating conditions of said rotatable paper tray, wherein said detection means is in said feeding device main body and is ON or OFF responsive to the forward or backward movement of said movable member.

2. The feeding device as set forth in claim 1, wherein said detection means includes:

a lateral feeding position sensor for detecting a condition wherein said rotatable paper tray is in a lateral feeding position; and a longitudinal feeding position sensor for detecting a condition wherein said rotatable paper tray is in a longitudinal feeding position.

3. A feeding device comprising:

a feeding device main body;

a rotatable paper tray unit removably attached to said feeding device main body, including a tray housing member having a transmission shaft member and a rotatable paper tray, said rotatable paper tray being coupled to said transmission shaft member through a movable member moving on said transmission shaft member, said rotatable paper tray being rotated to change a feeding position responsive to a forward or backward movement of said movable member by said transmission shaft member;

a shaft drive member on said movable member, moving with said movable member;

a shifting shaft member extending in a shifting direction of the transmission shaft member, freely moving in said shifting direction, said shifting shaft member being in a vicinity of said transmission shaft member;

an engaging member on said shifting shaft member, to be depressed by engaging said shaft drive member;

an elastic member for urging said shifting shaft member to be shifted at a predetermined position; and detection means for detecting operating conditions of said rotatable paper tray, said detection means being in said feeding device main body.

4. The feeding device as set forth in claim 3, wherein said detection means includes:

an action plate member for making a forward or backward movement according to a movement of said shifting shaft member driven by said shaft drive member; and switching means for turning ON or OFF responsive to a position of said action plate member.

5. The feeding device as set forth in claim 3, wherein said detection means includes:

an action plate member for making a forward or backward movement according to a depressing action by said shifting shaft member or a release of the depressing action taking place upon attaching or removing said rotatable paper tray unit to or from said feeding device main body, while also making a forward or backward movement according to a movement of said shifting shaft member driven by said shaft drive member, and switching means for turning ON or OFF according to a position of the action plate member.

6. The feeding device as set forth in claim 3, wherein said detection means includes:

a lateral feeding position sensor for detecting a condition wherein said rotatable paper tray is in a lateral feeding position; and a longitudinal feeding position sensor for detecting a condition wherein said rotatable paper tray is in a longitudinal feeding position.

7. The feeding device as set forth in claim 3, wherein said detection means includes:

a light interrupting plate;

a first optical sensor and a second optical sensor, each having a light emitting element and a light receiving element;

a shiftable rod fixed to said light interrupting plate, for making a forward or backward movement with said shifting shaft member;

an elastic member for depressing said shiftable rod to said shifting shaft member; and a guiding shaft fixed to said light interrupting plate, for permitting said light interrupting plate to slide in a moving direction of said shifting shaft member; said light interrupting plate being provided with a downward projecting wall, said downward projecting wall being provided with a first and second notched portions so as to form a first, second and third light interrupting portions at both sides of each of the notched portions, whereby each of the first and second optical sensors is ON when a light path between its respective light emitting element and light receiving element is maintained through the first notched portion or second notched portion, while turning OFF when the light path between its respective light emitting element and light receiving element is interrupted by the first, second or third light interrupting portion, according to a movement of the light interrupting plate.

8. A feeding device comprising:

a feeding device main body;

a rotatable paper tray unit removably attached to said feeding device main body, including a tray housing member having a rotative threaded member and a rotatable paper tray, said rotatable paper tray being coupled to said rotative threaded member through a movable member moving on said rotative threaded member, said rotatable paper tray being rotated to change a feeding position responsive to a forward or backward movement of said movable member by said rotative threaded member;

a depressing member on said rotative threaded member; and detection means in said feeding device main body, for detecting operating conditions of said rotatable paper tray, said rotatable paper tray having a first engaging section for setting a longitudinal feeding position and a first engaging section of setting a lateral feeding position, said tray housing member having a second engaging section for setting a longitudinal feeding position and a second engaging section for setting a lateral feeding position, said second engaging sections being in operative relations with the respective first engaging sections, each of the second engaging sections being adapted to set the rotatable paper tray in a predetermined feeding position by engaging either the first engaging section for longitudinal or lateral feeding position when said rotatable paper tray is to be located in either the longitudinal or lateral feeding position.

9. The feeding device as set forth in claim 8, wherein said detection means includes:

an action plate member for making a forward or backward movement according to a movement of said depressing member; and switching means for turning ON or OFF according to a position of the action plate member.

10. The feeding device as set forth in claim 8, wherein said detection means includes:

an action plate member for making a forward or backward movement according to a depressing action by said depressing member or a release of the depressing action taking place upon attaching or removing said rotatable paper tray unit to or from said feeding device main body, while also making a forward or backward movement according to a movement of said depressing member caused by rotations of said rotative threaded member, and switching means for turning ON or OFF according to a position of the action plate member.

11. The feeding device as set forth in claim 8, wherein said detection means includes:

a lateral feeding position sensor for detecting a condition wherein said rotatable paper tray is in a lateral feeding position; and a longitudinal feeding position sensor for detecting a condition wherein said rotatable paper tray is in a longitudinal feeding position.

12. The feeding device as set forth in claim 8, wherein said detection means includes:

a light interrupting plate;

a first optical sensor and a second optical sensor, each having a light emitting element and a light receiving element;

a shiftable rod fixed to said light interrupting plate, for making a forward or backward movement with said pressing member;

an elastic member for depressing the shiftable rod to said pressing member; and a guiding shaft fixed to said light interrupting plate, for permitting said light interrupting plate to slide in a moving direction of said shifting shaft member; said light interrupting plate being provided with a downward projecting wall, said downward projecting wall being provided with a first and second notched portions so as to form a first, second and third light interrupting portions at both sides of each of the notched portions, whereby each of the first and second optical sensors is ON when a light path between its respective light emitting element and light receiving element is maintained through the first notched portion or second notched portion, while turning OFF when the light path between its respective light emitting element and light receiving element is interrupted by the first, second or third light interrupting portion, according to a movement of the light interrupting plate.

* * * * *